US009494169B2

(12) United States Patent
Murakami et al.

(10) Patent No.: US 9,494,169 B2
(45) Date of Patent: Nov. 15, 2016

(54) ENGINE CONTROL APPARATUS FOR WORK MACHINE AND ENGINE CONTROL METHOD THEREOF

(71) Applicant: Komatsu Ltd., Tokyo (JP)

(72) Inventors: Kentaro Murakami, Chigasaki (JP); Tadashi Kawaguchi, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 43 days.

(21) Appl. No.: 14/344,728

(22) PCT Filed: May 31, 2013

(86) PCT No.: PCT/JP2013/065288

§ 371 (c)(1),
(2) Date: Mar. 13, 2014

(87) PCT Pub. No.: WO2014/192161

PCT Pub. Date: Dec. 4, 2014

(65) Prior Publication Data

US 2015/0135693 A1 May 21, 2015

(51) Int. Cl.
*F15B 13/01* (2006.01)
*F15B 21/08* (2006.01)
(Continued)

(52) U.S. Cl.
CPC ..... *F15B 13/01* (2013.01); *E02F 9/2012* (2013.01); *E02F 9/2066* (2013.01); *E02F 9/2292* (2013.01); *E02F 9/2296* (2013.01); *F02D 29/04* (2013.01); *F15B 13/14* (2013.01); *F15B 21/08* (2013.01); *F15B 21/082* (2013.01); *F15B 21/087* (2013.01); *F15B 2211/20523* (2013.01); *F15B 2211/20546* (2013.01);
(Continued)

(58) Field of Classification Search
CPC ..... E02F 9/2296; F15B 13/01; F15B 13/14; F15B 21/08; F15B 21/082; F15B 21/087; F15B 2211/80
See application file for complete search history.

(56) References Cited

U.S. PATENT DOCUMENTS 5,630,317 A 5/1997 Takamura et al.
6,654,676 B2 11/2003 Nakagawa et al.
(Continued)

FOREIGN PATENT DOCUMENTS

CN 1378938 A 11/2002
CN 1956871 A 5/2007
(Continued)

OTHER PUBLICATIONS

International Search Report dated Jun. 25, 2013, issued for PCT/JP2013/065288.
(Continued)

*Primary Examiner* — Logan Kraft
(74) *Attorney, Agent, or Firm* — Locke Lord LLP

(57) ABSTRACT

The present invention includes an information generator to set a lever manipulation amount total sum decrease flag during a period when a lever manipulation amount total sum is decreasing, a first processor to process an engine actual output, an engine actual output latching function block to output the maximum value of the engine actual output until the present during a period in which a lever manipulation amount total sum decrease flag is not set, and output the present engine actual output during a period in which the flag is set, a second processor to output an engine target output based on the engine output, and a controller to control the engine speed under limitation of the engine target output.

10 Claims, 24 Drawing Sheets

(51) Int. Cl.

| | |
|---|---|
| ***F02D 29/04*** | (2006.01) |
| ***E02F 9/20*** | (2006.01) |
| ***E02F 9/22*** | (2006.01) |
| ***F15B 13/14*** | (2006.01) |

(52) U.S. Cl.

CPC . *F15B 2211/20576* (2013.01); *F15B 2211/40* (2013.01); *F15B 2211/63* (2013.01); *F15B 2211/633* (2013.01); *F15B 2211/6309* (2013.01); *F15B 2211/6333* (2013.01); *F15B 2211/6346* (2013.01); *F15B 2211/6651* (2013.01); *F15B 2211/6658* (2013.01); *F15B 2211/72* (2013.01); *F15B 2211/75* (2013.01)

(56) References Cited

U.S. PATENT DOCUMENTS

| | | | | |
|---|---|---|---|---|
| 6,820,356 | B2 | 11/2004 | Naruse et al. | |
| 7,818,110 | B2 | 10/2010 | Ishibashi et al. | |
| 8,214,110 | B2 * | 7/2012 | Morinaga | B60L 1/003 172/4.5 |
| 9,121,158 | B2 | 9/2015 | Yamada | |
| 9,249,557 | B2 | 2/2016 | Moriki et al. | |
| 2003/0226291 | A1 | 12/2003 | Naruse et al. | |
| 2010/0235060 | A1 | 9/2010 | Yamada | |

FOREIGN PATENT DOCUMENTS

| | | | |
|---|---|---|---|
| CN | 101855433 | A | 10/2010 |
| EP | 0908564 | A2 | 4/1999 |
| JP | 2004-011502 | A | 1/2004 |
| JP | 2007-120426 | A | 5/2007 |
| JP | 2009-074404 | A | 4/2009 |
| JP | 2009-121262 | A | 6/2009 |
| JP | 2011-157931 | A | 8/2011 |
| JP | 2012-112528 | A | 6/2012 |
| JP | 2012-241585 | A | 12/2012 |
| JP | 2013-039875 | A | 2/2013 |
| WO | WO-2012/157387 | A1 | 11/2012 |

OTHER PUBLICATIONS

Office Action dated Feb. 22, 2016, issued for the corresponding German Patent Application No. 11 2013 000 220.5 and English translation thereof.

* cited by examiner np1: TARGET MATCHING ENGINE SPEED np1a: NO-LOAD ENGINE SPEED np2: NO-LOAD MAXIMUM ENGINE SPEED nm1: NO-LOAD MINIMUM ENGINE SPEED np1: TARGET MATCHING ENGINE SPEED
(LOW SPEED OFFSET ENGINE SPEED: HIGH)

np1': TARGET MATCHING ENGINE SPEED
(LOW SPEED OFFSET ENGINE SPEED: LOW)

np2: NO-LOAD MAXIMUM ENGINE SPEED np2': MATCHING ENGINE SPEED

ENGINE CONTROL APPARATUS FOR WORK MACHINE AND ENGINE CONTROL METHOD THEREOF

FIELD

The present invention relates to an engine control apparatus for a work machine including a construction machine such as an excavator, a bulldozer, a dump truck, a wheel loader, or the like, and an engine control method for such work machine.

BACKGROUND

In an engine control of a diesel engine (hereinafter referred to as "engine") used for a work machine, when an operator of the work machine optionally sets a fuel adjustment dial (throttle dial) provided in an operator room, an engine controller outputs a control signal to inject fuel into the engine, at an amount according to the setting, to a fuel injection system. So as to keep an target engine speed set by the fuel adjustment dial (throttle dial), the engine controller outputs a control signal corresponding to the change in load of the work apparatus attached to the work machine to the fuel injection system so as to adjust the engine speed. The engine controller or a pump controller calculates a target absorption torque of the hydraulic pump according to the target engine speed. The target absorption torque is set so as that the engine output horsepower is in balance with the absorption horsepower of the hydraulic pump.

Typical engine control will be described using FIG. 24. The engine is controlled so as not to exceed an engine output torque line TL determined by a maximum output torque line P1 of the engine and an engine droop line Fe drawn from the maximum engine speed. For example, when the work machine is an excavator or the like, the engine controller generates a control signal for changing the engine speed according to the manipulation amount of a manipulating lever which is manipulated for swinging an upper swing body or operating the work apparatus and the load of the work apparatus or the like. For example, when an operation of excavating earth, sand, or the like is carried out with the target engine speed set at N2, changeover is made from the engine speed at which the engine idles (idling engine speed N1) to the target engine speed N2. In this changeover, the fuel injection system, by receiving the control signal from the engine controller, injects fuel into the engine according to the changeover, and thereby the load increases by the operation of the work apparatus or the like. Thereby, the engine speed changes over so as that the engine speed and the engine output torque reach a matching point M1 corresponding to the intersection point of the pump absorption torque line PL of a variable displacement hydraulic pump (typically, a swash plate type hydraulic pump) and the engine output torque line TL. Note that, the engine output is maximum at the rated point P.

As illustrated in FIG. 25, in order to improve fuel consumption efficiency of the engine and pump efficiency of the hydraulic pump, an engine control apparatus in which a target engine operating line (target matching route) ML which runs through the region where fuel consumption rate is preferable is provided, and a matching point of the engine output and the pump absorption torque is provided on the target matching route ML. In FIG. 25, the curve M illustrates a constant fuel consumption curve of an engine, and the fuel consumption rate is better in the region close to the center of the curve M (eye M1). Further, a curve J illustrates a constant horsepower curve in which the horsepower absorbed by the hydraulic pump is constant horsepower. Therefore, regarding cases in which the same horsepower is obtained, the fuel consumption rate is better in the case when the matching is made at a matching point pt2 on the target matching route ML than in the case when the matching is made at a matching point pt1 on the engine droop line Fe. Further, the flow rate Q of the hydraulic pump is the product of the engine speed n and the pump capacity q ($Q=n \cdot q$). Therefore, to obtain the same work fluid flow rate, pump efficiency is better when the engine speed is reduced so as to increase the pump capacity.

CITATION LIST

Patent Literature

Patent Literature 1: Japanese Patent Application Laid-open No. 2007-120426

Patent Literature 2: Japanese Patent Application Laid-open No. 2012-241585

SUMMARY

Technical Problem

However, for example, in a conventional engine control apparatus according to Patent Literature 2, the engine target output can be changed, though no consideration is made to decrease the engine target output when the engine actual output decreases by moving a manipulating lever in a decrease-direction. Conventionally, it is not until the manipulating lever returns to neutral that the engine target output decreases.

When the engine target output does not decrease, even though the engine actual output has decreased by moving the manipulating lever in a decrease-direction, the engine speed moves along on the droop line which includes the matching point of the engine target output, as the engine actual output decreases, to increase the engine speed. This causes a problem of deterioration in fuel consumption rate.

The present invention is made in view of the problem. The object of the present invention is to provide an engine control apparatus of a work machine which can improve fuel consumption rate by setting an engine target output according to the intention of a manipulator, and an engine control method for the engine control apparatus.

Solution to Problem

To achieve the object mentioned above, according to the present invention, an engine control apparatus of a work machine including an engine, a work apparatus driven by at least engine power and a manipulating lever which operates at least an operation of the work apparatus, the apparatus comprises: an engine output decrease allowing information generating unit configured to generate an engine output decrease allowing information which allows decrease in an engine output during a period in which a lever manipulation amount total sum of the manipulating lever is decreasing; an engine actual output processing unit configured to process an engine actual output based on engine torque and an engine speed; a latching function unit configured to keep and output a maximum value of the engine actual output until present during a period in which the engine output decrease allowing information is not generated, and output a present value of the engine actual output during a period in which the engine output decrease allowing information is generated; an engine target output processing unit configured to process and output an engine target output based on an engine output which is output by the latching function unit; and an engine controller configured to control the engine speed under limitation of the engine target output.

In the present invention, the engine output decrease allowing information generating unit includes a hysteresis processing unit configured to carry out hysteresis processing in which when an amount of change in a decreasing-direction of the lever manipulation amount total sum which is input is equal to, or greater than, a predetermined amount, under a state in which the engine output decrease allowing information is not generated, the lever manipulation amount total sum is determined to have decreased so that the engine output decrease allowing information is generated, and when an amount of change in an increasing-direction of the lever manipulation amount total sum which is input is equal to, or greater than, a predetermined amount, under a state in which the engine output decrease allowing information is generated, the lever manipulation amount total sum is determined to have increased so that the engine output decrease allowing information is not generated.

In the present invention, the engine output decrease allowing information generating unit is configured not to generate the engine output decrease allowing information when pump pressure exceeds a predetermined high pressure threshold.

In the present invention, the engine control apparatus of a work machine further comprises a single touch power-up button configured to output a single touch power-up signal which gives a command to temporarily increase the engine output, wherein the engine output decrease allowing information generating unit is configured not to generate the engine output decrease allowing information during a period when the single touch power-up button signal is input.

In the present invention, the engine target output processing unit is configured not to carry out processing in a direction in which an engine target output increases when the engine output decrease allowing information is generated.

According to the present invention, an engine control method for a work machine including an engine, a work apparatus driven by at least engine power, and a manipulating lever which operates at least an operation of the work apparatus, the method comprises: an engine output decrease allowing information generating step in which an engine output decrease allowing information which allows decrease in an engine output during a period when a lever manipulation amount total sum of a manipulating lever is decreasing is generated; an engine actual output processing step in which an engine actual output is processed based on engine torque and an engine speed; a latching function step in which a maximum value of the engine actual output until present is kept and output during a period when the engine output decrease allowing information is not generated, and a present value of the engine actual output is output during a period when the engine output decrease allowing information is generated; an engine target output processing step in which an engine target output is processed and output based on an engine output which is output by the latching function step; and an engine control step in which the engine speed is controlled under limitation of the engine target output.

In the present invention, the engine output decrease allowing information generating step includes a hysteresis processing step which carries out hysteresis processing in which when an amount of change in a decreasing-direction of the lever manipulation amount total sum which is input is equal to, or greater than, a predetermined amount, under a state in which the engine output decrease allowing information is not generated, the lever manipulation amount total sum is determined to have decreased so that the engine output decrease allowing information is generated, and when an amount of change in an increasing-direction of the lever manipulation amount total sum which is input is equal to, or greater than, a predetermined amount, under a state in which the engine output decrease allowing information is generated, the lever manipulation amount total sum is determined to have increased so that the engine output decrease allowing information is not generated.

According to the present invention, the engine target output is processed and output based on an engine output which is output in the following manner. During a period when a lever manipulation amount total sum of the manipulating lever is decreasing, an engine output decrease allowing information which allows decrease in the engine output is generated. During a period when the engine output decrease allowing information is not generated, the maximum engine actual output until the present is kept and output. During a period when the engine output decrease allowing information is generated, the present engine actual output is output. As a result, also during the period when the lever manipulation amount total sum is decreasing, the engine target output according to the engine actual output can surely be set, thereby enabling improvement in fuel consumption rate according to the intention of the manipulator.

DESCRIPTION OF EMBODIMENTS

The embodiment of the present invention will be described below referring to the attached drawings.

First Embodiment

Overall Configuration

Figure 1:
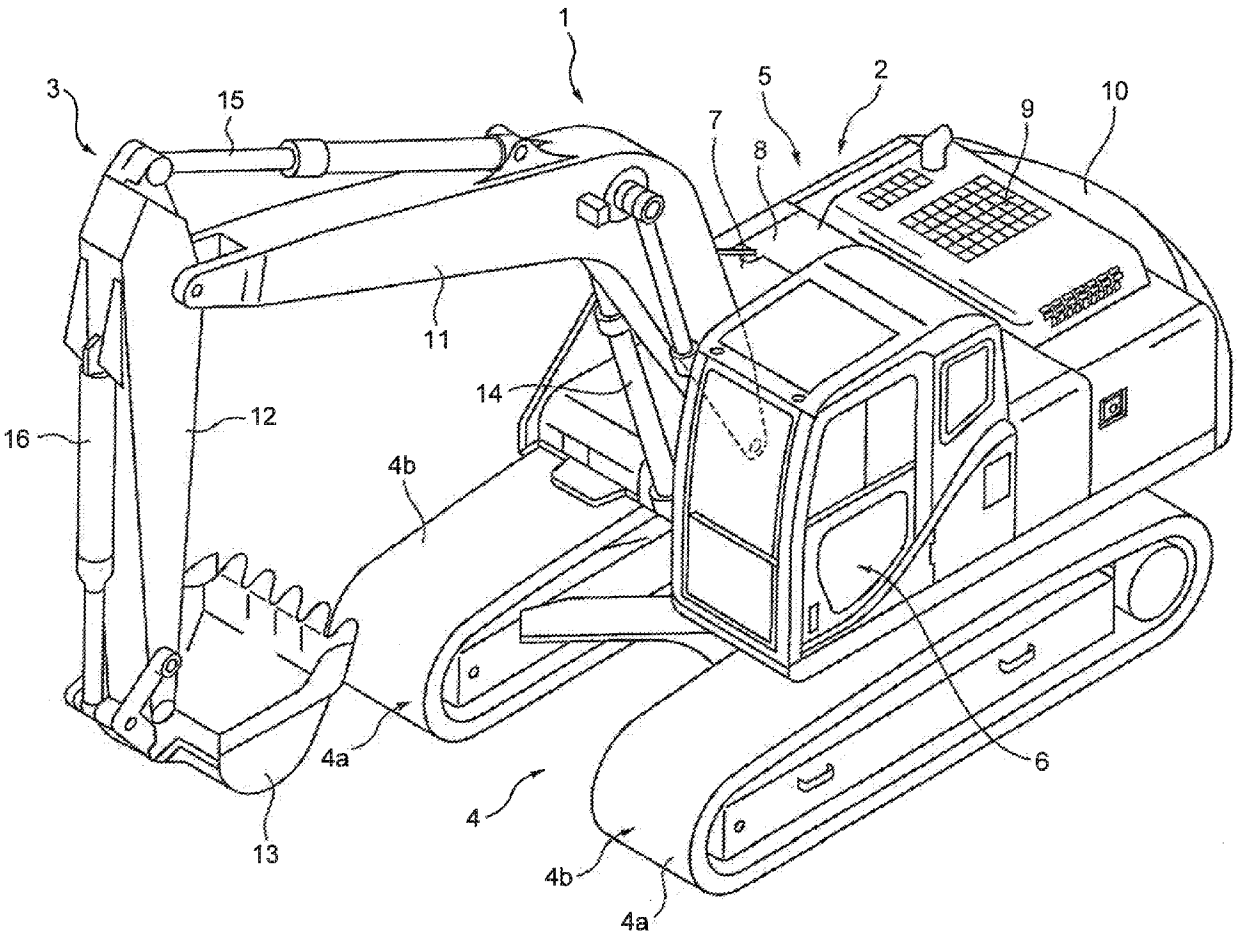
FIG. 1 is a perspective view illustrating overall configuration of an excavator according to a first embodiment of the present invention.
Figure 2:
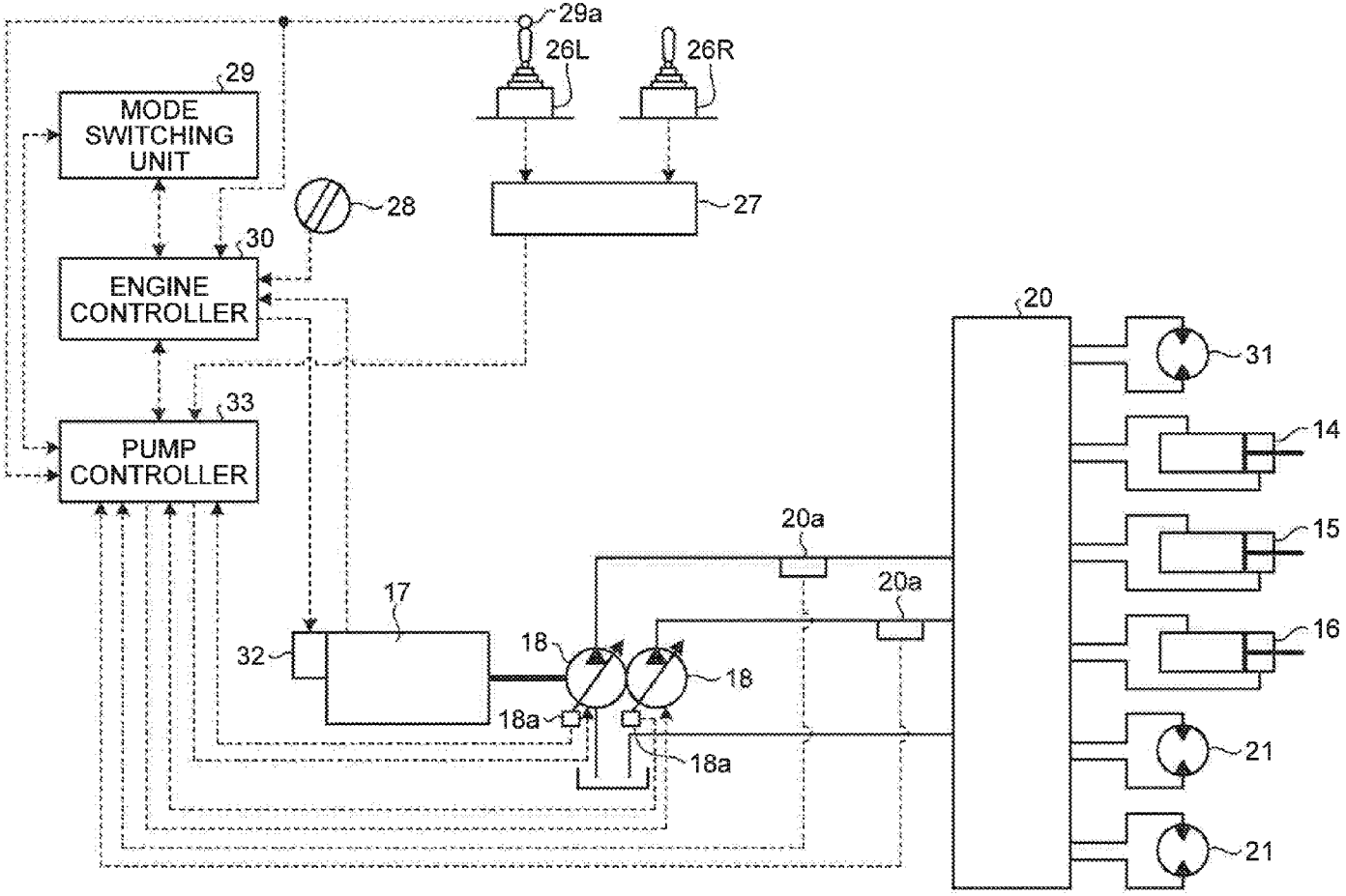
FIG. 2 is a schematic diagram illustrating a configuration of a control system of the excavator illustrated in FIG. 1.

An overall configuration of an excavator 1, as an example of a work machine, is illustrated in FIG. 1 and FIG. 2. The excavator 1 includes a vehicle main body 2 and a work machine 3. The vehicle main body 2 includes a bottom traveling body 4 and an upper swing body 5. The bottom traveling body 4 includes a pair of traveling apparatuses 4*a*. Each traveling apparatus 4*a* includes a crawler track 4*b*. Each traveling apparatus 4*a* drives the crawler track 4*b* by a right traveling motor and a left traveling motor (traveling motor 21) to travel or turn the excavator 1.

The upper swing body 5 is swingably provided on the bottom traveling body 4, and swings by the driving of the swing hydraulic motor 31. Further, an operator room 6 is provided in the upper swing body 5. The upper swing body 5 includes a fuel tank 7, a working fluid tank 8, an engine room 9, and a counter weight 10. The fuel tank 7 stores fuel for driving an engine 17. The working fluid tank 8 stores working fluid which is discharged from a hydraulic pump 18 to a hydraulic cylinder such as a boom cylinder 14 and to a hydraulic equipment such as the swing hydraulic motor 31 and the traveling motor 21. The engine room 9 contains an equipment such as the engine 17 and the hydraulic pump 18. The counter weight 10 is arranged in the rear of the engine room 9.

The work machine 3 is attached to the forward central portion of the upper swing body 5, and includes a boom 11, an arm 12, a bucket 13, the boom cylinder 14, an arm cylinder 15, and a bucket cylinder 16. The proximal end portion of the boom 11 is pivotally connected to the upper swing body 5. Further, the distal end portion of the boom 11 is pivotally connected to the proximal end portion of the arm 12. The distal end portion of the arm 12 is pivotally connected to the bucket 13. The boom cylinder 14, the arm cylinder 15, and the bucket cylinder 16 are hydraulic cylinders driven by the work fluid discharged from the hydraulic pump 18. The boom cylinder 14 operates the boom 11. The arm cylinder 15 operates the arm 12. The bucket cylinder 16 operates the bucket 13.

In FIG. 2, the excavator 1 includes the engine 17 as a driving source and the hydraulic pump 18. A diesel engine is used as the engine 17, and a variable displacement hydraulic pump (e.g., a swash plate type hydraulic pump) is used as the hydraulic pump 18. The hydraulic pump 18 is mechanically connected to an output shaft of the engine 17, and the hydraulic pump 18 is driven by driving the engine 17.

As for a hydraulic driving system, each of a traveling lever, which is not illustrated in the drawing, to drive the right and left traveling apparatuses 4*a* and manipulating levers 26R and 26L to drive the work machine 3, the upper swing body 5, or the like, is provided in the operator room 6 provided in the vehicle main body 2. The up-and-down and right-and-left manipulations of the manipulating lever 26R set the supply amount of the working fluid corresponding to extension and contraction of the boom cylinder 14 and the bucket cylinder 16, respectively. The up-and-down and right-and-left manipulations of the manipulating lever 26L set the supply amount of the working fluid supplied to the arm cylinder 15 and the swing hydraulic motor 31 which drives the upper swing body 5, respectively. The manipulation amount of the manipulating levers 26R and 26L is converted into an electric signal by a lever manipulation amount detecting unit 27. The lever manipulation amount detecting unit 27 is configured with a pressure sensor. The pressure sensor detects pilot hydraulic pressure produced according to the manipulation of the manipulating levers 26R and 26L and obtains the lever manipulation amount by converting voltage or the like which is output by the pressure sensor into the lever manipulation amount. The lever manipulation amount is output to a pump controller 33 as an electric signal. Note that, in the case when the manipulating levers 26R and 26L are electric levers, the lever manipulation amount detecting unit 27 is configured with an electrically detecting means such as a potentiometer. The voltage or the like generated according to the lever manipulation amount is converted into the lever manipulation amount to obtain the lever manipulation amount.

In the operator room 6, a fuel adjustment dial (throttle dial) 28, a mode switching unit 29, and a single touch power-up button 29*a* are provided in the upper portion of the manipulating lever 26L. The single touch power-up button 29*a* may independently be installed in a portion other than the upper portion of the manipulating lever 26L. The fuel adjustment dial (throttle dial) 28 is a switch used to set a supply amount of fuel to the engine 17. The setting value of the fuel adjustment dial (throttle dial) 28 is converted into an electric signal and output to an engine controller 30.

The engine controller 30 is configured with a processing device such as a CPU (numeric data processor) and a memory (storing device). The engine controller 30 generates a control command signal based on the setting value of the fuel adjustment dial (throttle dial) 28. A common rail control unit 32 receives the control signal and adjusts the fuel injection amount to the engine 17. That is, the engine 17 is such engine which allows common rail type electronic control, in which a target output can be output by suitably controlling the fuel injection amount and the degree of torque which can be output under the engine speed at a certain moment can freely be set.

The mode switching unit 29 sets the work mode of the excavator 1 to a power mode or an economy mode and configured with, for example, an operation button or a switch, and a touch panel provided in the operator room 6. The operator of the excavator 1 can operate those operating buttons or the like to switch the work mode. The power mode is a work mode in which the engine control and the pump control are carried out so as to maintain a great amount of work load and suppress fuel consumption rate. The economy mode is a work mode in which the engine control and the pump control are carried out so as to further suppress the fuel consumption rate and provide an operating speed of the work machine 3 under a small amount of work load. By setting the mode switching unit 29 (switching of a work mode), an electric signal is output to the engine controller 30 and the pump controller 33. Note that, in the power mode, the output torque of the engine 17 and the absorption torque of the hydraulic pump 18 are matched in the region in which the engine speed and the output torque of the engine 17 are relatively high. Further, in the economy mode, the matching is carried out at an engine output relatively smaller than the case of the power mode.

The single touch power-up button 29*a* gives a command to temporarily increase the engine output. When the single touch power-up button 29*a* is pushed, a single touch power-up signal is output to the engine controller 30 and the pump controller 33 during a period of, for example, five to ten seconds. The engine controller 30 and the pump controller 33 temporarily increase the engine output during the period in which the single touch power-up signal is input.

The pump controller 33 receives the signal transmitted from the engine controller 30, the mode switching unit 29, the single touch power-up button 29*a*, and the lever manipulation amount detecting unit 27, and produces a control command signal to adjust the discharge amount of work fluid from the hydraulic pump 18 by tilt-controlling the swash plate angle of the hydraulic pump 18. Note that, a signal from a swash plate angle sensor 18*a* which detects the swash plate angle of the hydraulic pump 18 is input to the pump controller 33. By the swash plate angle sensor 18*a* detecting the swash plate angle, the pump capacity of the hydraulic pump 18 can be processed. To a pipe between the hydraulic pump 18 and a control valve 20, a pump pressure detecting unit 20*a* which detects pump discharge pressure of the hydraulic pump 18 is provided. The detected pump discharge pressure is converted into an electric signal and input to the pump controller 33. The engine controller 30 and the pump controller 33 are connected with an interior LAN such as a CAN (Controller Area Network) so as to transmit and receive information between each other.

Outline of Engine Control

The outline of the engine control will be described referring to a torque line chart illustrated in FIG. 3 and FIG. 4. The engine controller 30 acquires information (signal representing the state of operation) such as the lever manipulation amount, the work mode and the setting value of the fuel adjustment dial (throttle dial) 28, the swing speed (swing-rotation speed) of the upper swing body 5, or the like so as to obtain an engine output command value. The engine output command value constitutes a constant horsepower curve (engine output command value curve) EL1 on the torque line chart, which limits the engine output.

Figure 3:
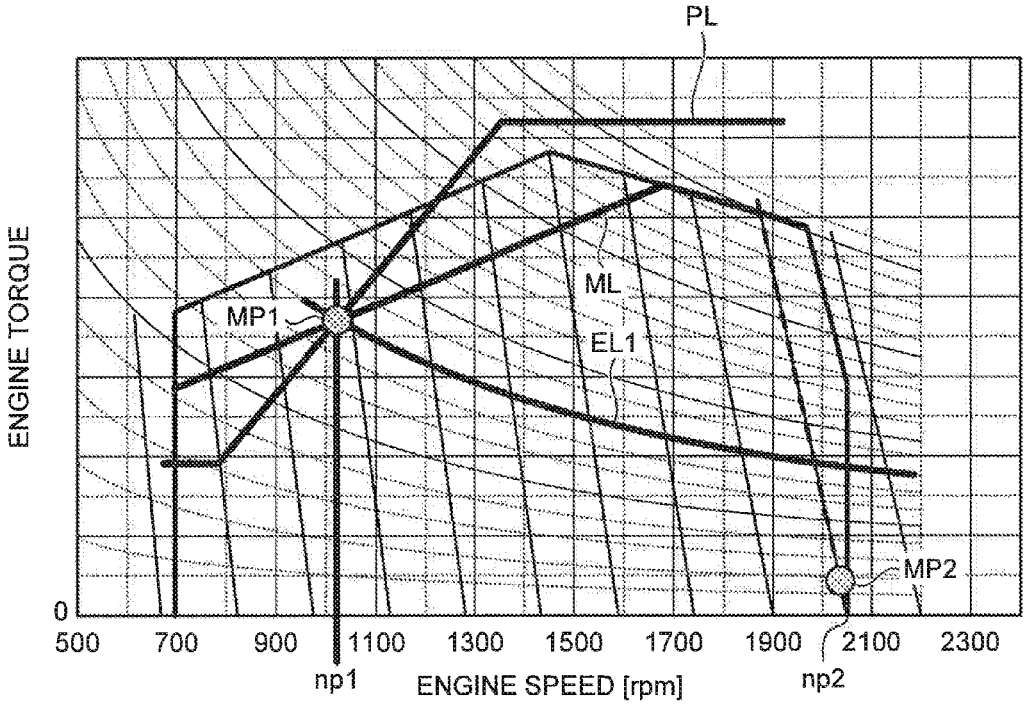
FIG. 3 is a torque line chart explaining a detail of engine control by an engine controller or a pump controller.

Further, as illustrated in FIG. 3, when a load is applied to the work machine 3, the work machine 3 is operated by matching the engine output and the hydraulic pump output at MP1 which is an intersection point (target matching point) of the engine output command value curve EL1 and the pump absorption torque line PL, without restricting the engine output by the droop line. Note that, the target matching point MP1 is preferably provided on the target matching route ML. The engine speed at the target matching point MP1 is a target matching engine speed np1. For example, in FIG. 3, np1 is around 1000 rpm. In this manner, the work machine 3 can obtain sufficient output, and also the fuel consumption rate can be suppressed in a low level since the engine 17 is driven at a low engine speed.

Figure 4:
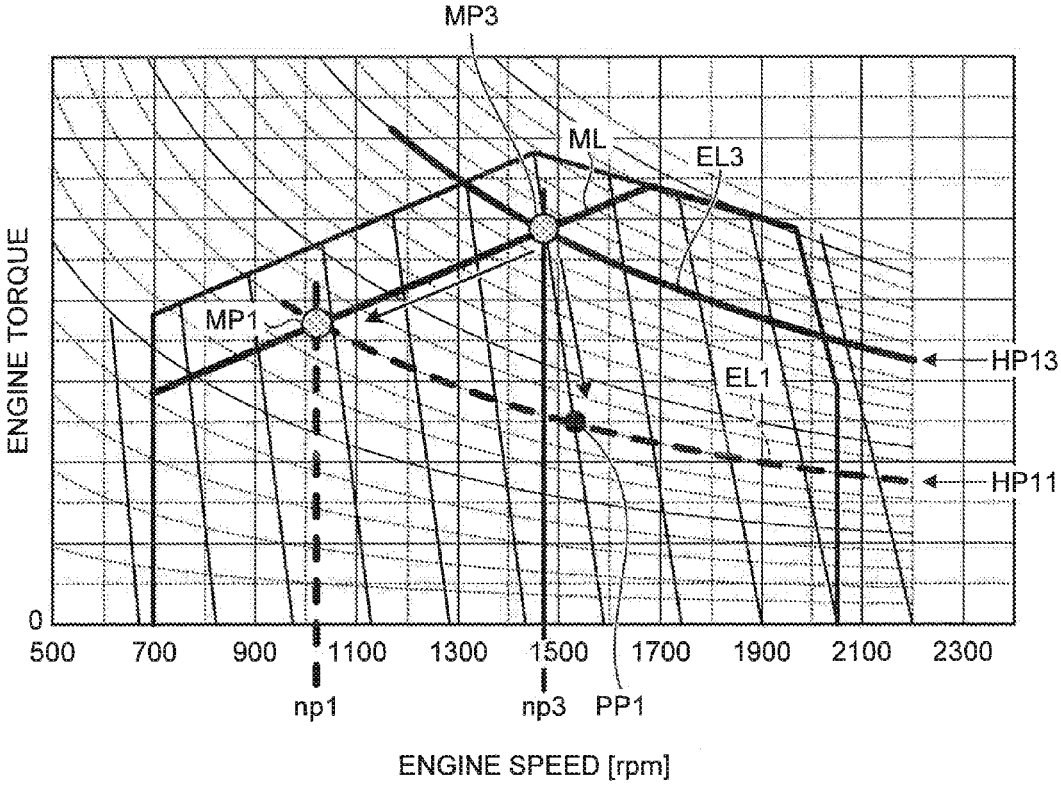
FIG. 4 is a torque line chart explaining a detail of engine control by an engine controller or a pump controller using a lever manipulation amount total sum decrease flag.

As illustrated in FIG. 4, when further load is applied to the work machine 3, the engine target output increases and changeover is made from the engine output command value curve EL1 representing the engine actual output HP11 of the same horsepower to the engine output command value curve EL3 representing the engine actual output HP13 of the same horsepower (HP11<HP13). Then, the target matching point MP1 moves along on the matching route ML, in the direction in which the engine output increases, to become a target matching point MP3 which is an intersection point of the engine output command value curve EL3 and the matching route ML. In this state, when the engine actual output (engine load) decreases, the engine torque decreases along the droop line which includes the target matching point MP3 and at the same time the engine speed increases. When the lever manipulation amount decreases by the lever manipulation of the operator, the engine target output decreases along with the decrease in the lever manipulation amount. For example, in FIG. 4, the engine target output changes over from the engine output command value curve EL3 to the engine output command value curve EL1.

As described above, when the engine actual output decreases by the decrease in the lever manipulation amount, the engine target output decreases corresponding to the decrease in the engine actual output. As a result, in FIG. 4, the changeover is made from the target matching point MP3 to the target matching point MP1, and along with this changeover, the engine speed drastically decreases from np3 to np1, allowing improvement in fuel consumption rate. Note that, conventionally, the engine target output does not decrease corresponding to the decrease in the engine actual output by the decreasing of the lever manipulation amount. Therefore, the target matching point MP3 is maintained, although the engine actual output decreases by the decreasing of the lever manipulation amount. As a result, when the engine actual output decreases by the decreasing of the lever manipulation amount, the point PP1 which is an intersection point of the droop line including the target matching point MP1 and the engine output command value curve EL1 corresponding to the engine actual output HP11 at this moment becomes an operating point. In this state, the engine speed is higher than np1, and further, higher than np3, which results in deterioration in fuel consumption rate.

Now, as for the case when the engine target output does not change and the load on the work machine 3 has dropped so that the flow rate of working fluid is required for the hydraulic cylinders 14, 15, and 16 of the work machine 3, in other words, the case when the operating speed of the work machine 3 is required to be provided will be discussed. The engine controller 30 determines a no-load maximum engine speed np2 (e.g., around 2050 rpm in FIG. 3) which corresponds to information such as a lever manipulation amount, a swing-rotation speed of the upper swing body 5, a setting value of the fuel adjustment dial (throttle dial) 28 and controls the engine droop within the engine speed range between the target matching engine speed np1 and the no-load maximum engine speed np2 to drive the engine 17. By carrying out such control, when the loaded state of the work machine 3 changes over to the state in which the load has dropped, the changeover is made from the target matching point MP1 in the low engine speed side to the matching point MP2 in the high engine speed side. Thereby, the working fluid flow rate discharged from the hydraulic pump 18 can be supplied, by sufficient amount, to the hydraulic cylinders 14, 15, and 16, allowing to provide the operating speed of the work machine 3. Further, since the engine output is restricted by the engine output command value curve EL, the waste of energy does not occur. Note that, the no-load maximum engine speed np2 is not limited to the maximum engine speed which the engine can output.

Figure 5:
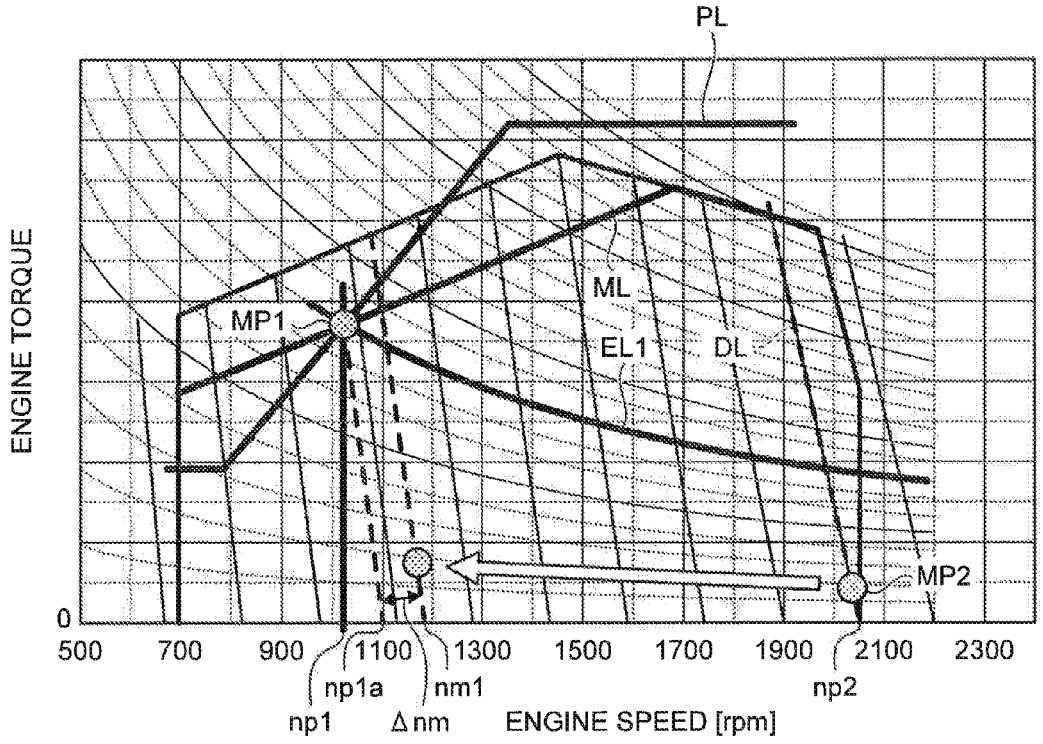
FIG. 5 is a torque line chart explaining a detail of engine control by an engine controller or a pump controller.

Further, when the load on the work machine 3 has further dropped without change in the engine target output, the fuel consumption rate is deteriorated if the engine 17 is kept driving in a high engine speed range consuming fuel. Consequently, in the case when the load has dropped but the requirement of the discharge flow rate and discharge pressure of the work fluid from the hydraulic pump 18 is not so high, such as in a case, for example, when only the bucket 13 is operated, that is, when there is a margin of the pump capacity, the control in which the droop line DL in the high engine speed range is shifted to the low engine speed range is carried out as illustrated in FIG. 5. As mentioned above, the pump capacity is detected by the swash plate angle sensor 18*a*, and the droop line DL is shifted according to the magnitude of the detected value. For example, when the pump capacity is detected to be greater than a predetermined value, that is, when the working fluid flow rate is required, the droop line DL is shifted to the high engine speed range to increase the engine speed. When the pump capacity is detected to be smaller than a predetermined value, that is, when the working fluid flow rate is not required, the droop line DL is shifted to the lower engine speed range to decrease the engine speed. By carrying out such control, unnecessary fuel consumption by the engine driven in the high engine speed range can be suppressed.

Detail of Engine Control

Figure 6:
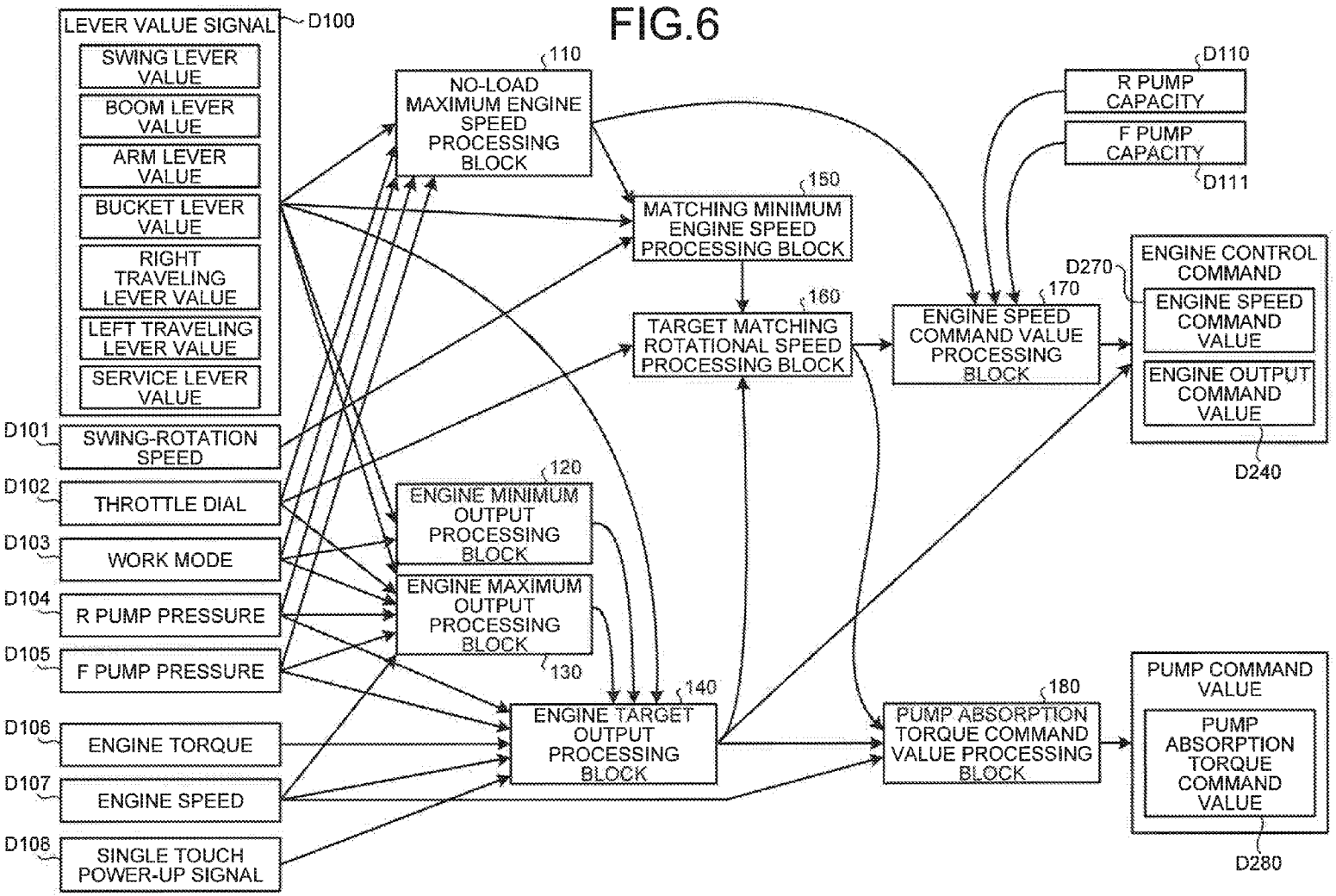
FIG. 6 is a figure illustrating an overall control flow of an engine controller or a pump controller.

FIG. 6 illustrates an overall control flow by the engine controller 30 or the pump controller 33. The engine controller 30 or the pump controller 33 finally processes an engine speed command value and an engine output command value as an engine control command, and a pump absorption torque command value as a pump control command.

Figure 7:
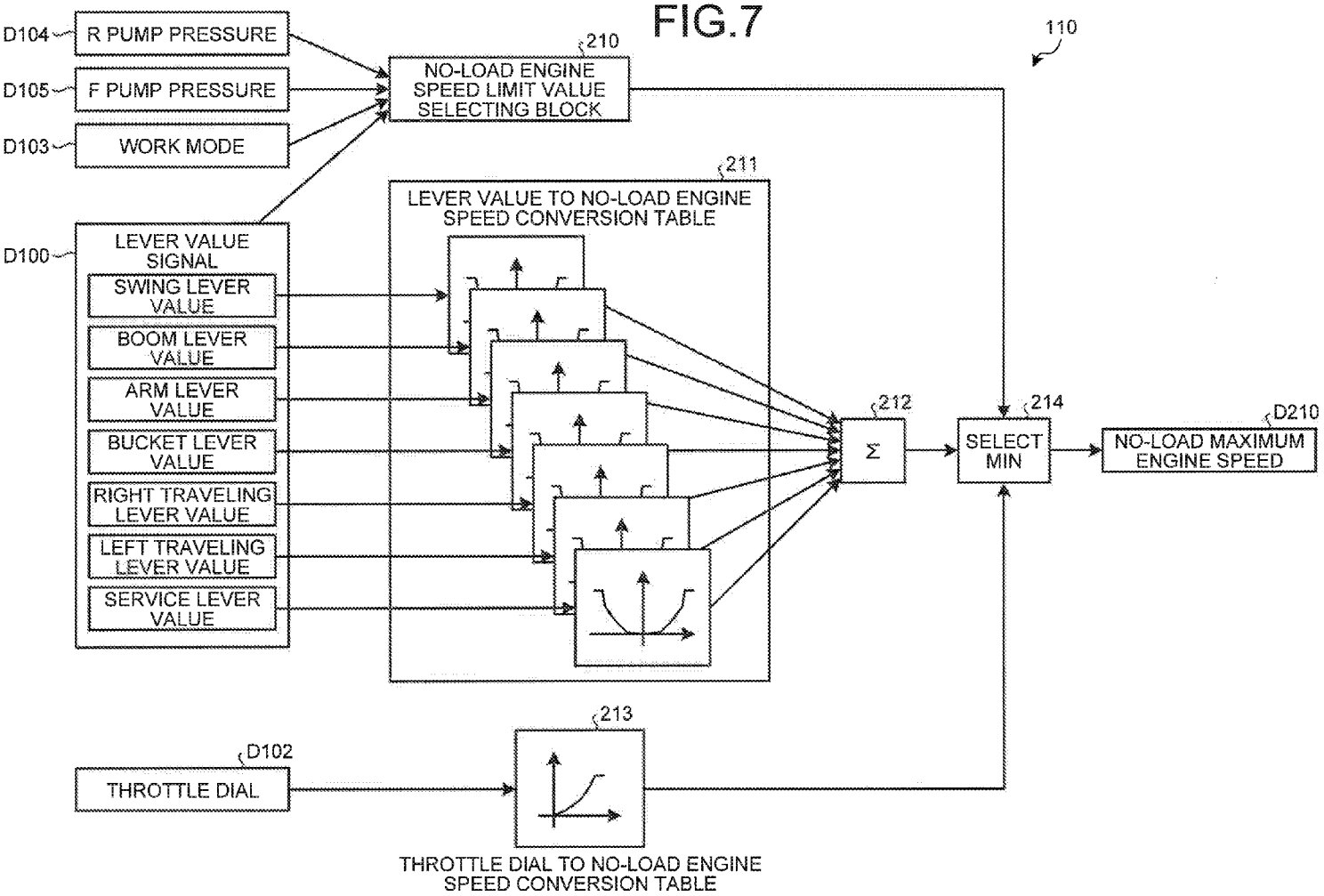
FIG. 7 is a figure illustrating a detailed control flow of a no-load maximum engine speed processing block illustrated in FIG. 6.

A no-load maximum engine speed processing block 110 processes a no-load maximum engine speed D210 (np2) which is an upper limit value of the engine speed command value by the detailed control flow illustrated in FIG. 7. In a state in which the pump capacity of the hydraulic pump 18 is maximum, the flow rate of the hydraulic pump 18 (hydraulic pump discharge flow rate) is the product of the engine speed and the pump capacity. Since the flow rate of the hydraulic pump 18 (hydraulic pump discharge flow rate) is proportional to the engine speed, the no-load maximum engine speed D210 is in a proportional relation to the flow rate of the hydraulic pump 18 (pump maximum discharge amount). Thus, firstly, as a candidate value for the no-load maximum engine speed D210, the total sum of no-load engine speeds each of which obtained from each lever value signal D100 (lever manipulation amount) is obtained in a total sum unit 212. Each of the lever value signal D100 (signal representing each lever manipulation amount) may be a swing lever value, a boom lever value, an arm lever value, a bucket lever value, a traveling right lever value, a traveling left lever value, and a service lever value. In the case when a hydraulic circuit to which an additional hydraulic actuator can be connected is included, the service lever value represents the lever manipulation amount to manipulate the hydraulic actuator. Each lever value signal D100 is converted into a no-load engine speed by a lever value to no-load engine speed conversion table 211 as illustrated in FIG. 7. The total sum of the converted values, that is the no-load engine speed produced in the total sum unit 212 is output to a minimum value selecting unit (select MIN) 214.

Further, a no-load engine speed limit value selecting block 210 decides, by using four pieces of information which are a manipulation amount of each lever value signal D100, pump pressures D104 and D105 which are the discharge pressure of the hydraulic pump 18, and a work mode D103 set by the mode switching unit 29, which operation pattern (work pattern) is presently performed by the operator of the excavator 1. Then the no-load engine speed limit value selecting block 210 selects and determines a no-load engine speed limit value for the operation pattern which is previously set. The determined no-load engine speed limit value is output to the minimum value selecting unit 214. As for making decision of the operation pattern (work pattern), for example, when the arm lever is tilted toward the direction of excavation and the pump pressure is higher than a setting value, the decision is made that the excavator 1 is to perform an excavation operation. In a case of combined operation such as when the swing lever is tilted and the boom lever is tilted to the upward direction, the decision is made that the excavator 1 is to perform hoist swinging operation. As described above, to decide the operation pattern (work pattern) is to estimate which operation the operator is intending to perform. Note that, the hoist swinging operation is an operation in which the upper swing body 5 swings and at the same time the earth and sand excavated by the bucket 13 are lifted by the boom 11, and then the upper swing body 5 stops swinging at a desired location and the earth and sand are removed from the bucket 13.

Further, from the setting state (setting value) of the fuel adjustment dial 28 (throttle dial D102), a candidate value for the no-load maximum engine speed is determined. That is, on receiving a signal representing the setting value of the fuel adjustment dial 28 (throttle dial D102), the setting value is converted into a candidate value for the no-load maximum engine speed by a throttle dial to no-load engine speed conversion table 213. The candidate value is output to the minimum value selecting unit 214.

The minimum value selecting unit 214 selects the minimum value from three values which are the no-load engine speed obtained from the lever value signal D100, the no-load engine speed limit value obtained in the no-load engine speed limit value selecting block 210, and the no-load engine speed obtained from the setting value of the throttle dial D102, and outputs the no-load maximum engine speed D210 (np2).

Figure 8:
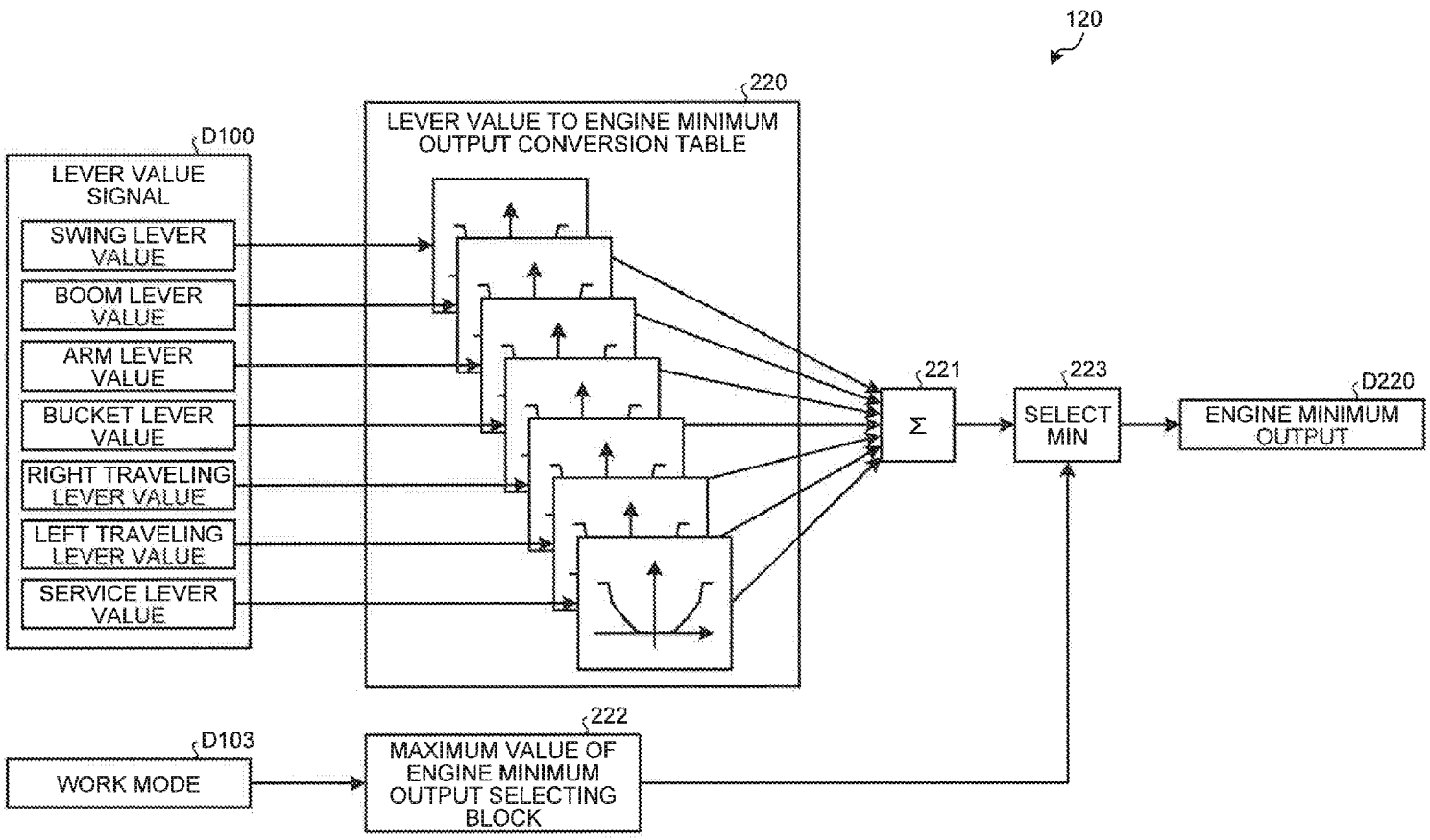
FIG. 8 is a figure illustrating a detailed control flow of an engine minimum output processing block illustrated in FIG. 6.

FIG. 8 is a detailed control flow of an engine minimum output processing block 120. As illustrated in FIG. 8, the engine minimum output processing block 120 processes an engine minimum output D220 which is to be a lower limit value of the engine output command value. Similar to the processing of the no-load maximum engine speed, a lever value to engine minimum output conversion table 220 converts each lever value signal D100 into an engine minimum output. A total sum unit 221 outputs the total sum of the engine minimum outputs to a minimum value selecting unit (select MIN) 223.

Further, a maximum value of engine minimum output selecting block 222 outputs the maximum value of the engine minimum output corresponding to the work mode D103, which is set by the mode switching unit 29, to the minimum value selecting unit 223. The minimum value selecting unit 223 compares the total sum of engine minimum outputs each corresponding to each lever value signal D100 with the maximum value of the engine minimum output corresponding to the work mode D103 to select the minimum value, and then outputs the minimum value as the engine minimum output D220.

Figure 9:
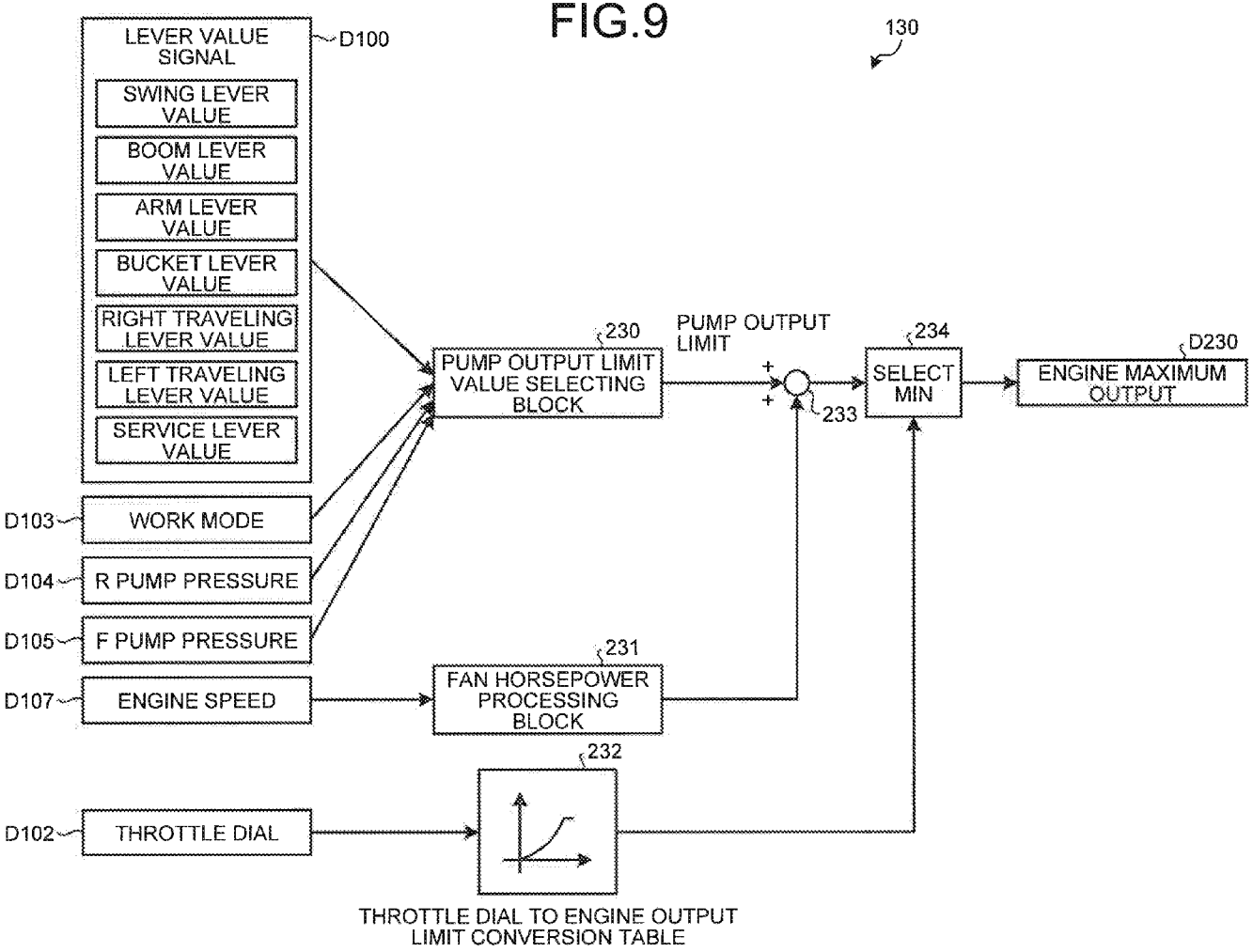
FIG. 9 is a figure illustrating a detailed control flow of an engine maximum output processing block illustrated in FIG. 6.

FIG. 9 is a detailed control flow of an engine maximum output processing block 130. As illustrated in FIG. 9, the engine maximum output processing block 130 processes an engine maximum output D230 which is to be an upper limit value of the engine output command value. Similar to the processing of the no-load maximum engine speed processing block 110, a pump output limit value selecting block 230 decides the present operation pattern using information of the manipulation amount of each lever value signal D100, the pump pressures D104 and D105, and the setting value of the work mode D103. Then the pump output limit value selecting block 230 selects a pump output limit value for each operation pattern. A fan horsepower processed, by a fan horsepower processing block 231, from an engine speed D107 detected by an engine speed sensor, which is not shown in the drawing, is added to the selected pump output limit value by an adding unit 233. The value which is added (hereinafter referred to as "added value") and the engine output limit value which is produced through conversion according to the setting value of the fuel adjustment dial 28 (throttle dial D102) by the throttle dial to engine output limit conversion table 232 are output to the minimum value selecting unit (select MIN) 234. Note that, as illustrated in FIG. 9, in the throttle dial to engine output limit conversion table 232, the horizontal axis represents the setting value of the throttle dial and the vertical axis represents the engine output limit value corresponding to the dial value. The setting is made so as that the engine output limit value is minimum when the throttle dial value is 0, and the engine output limit value increases as the throttle dial value increases. The minimum value selecting unit 234 selects the minimum value of the added value and the engine output limit value, and outputs the selected value as the engine maximum output D230. Note that, the fan is provided in the vicinity of a radiator which cools the engine 17 so as to blow air toward the radiator, and be rotatably driven together with the driving of the engine 17. Note that, the fan horsepower can simply be obtained through calculation using an equation expressed below.

$$\text{fan horsepower} = \text{rated fan horsepower} \times (\text{engine speed}/\text{engine speed at rated fan})^3$$

Engine Target Output Processing

Figure 10:
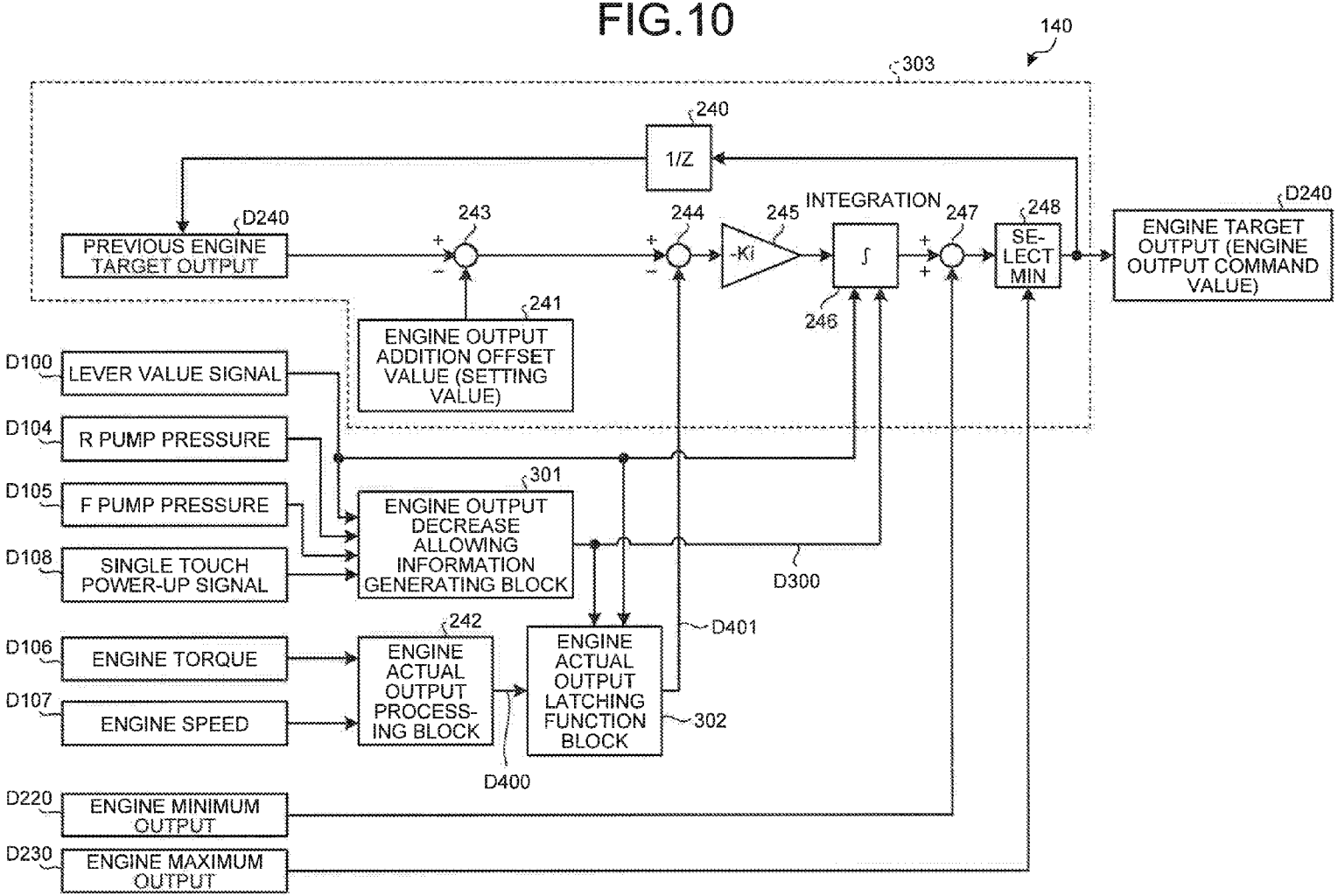
FIG. 10 is a figure illustrating a detailed control flow of an engine target output processing block illustrated in FIG. 6.

FIG. 10 is a detailed control flow of an engine target output processing block 140. AS illustrated in FIG. 10, the engine target output processing block 140 includes an engine output decrease allowing information generating block 301, an engine actual output processing block 242, an engine actual output latching function block 302, and an engine target output processing unit 303 and processes an engine target output D240 which is the engine output command value.

First, the engine target output processing unit 303 will be described. A subtracting unit 243 subtracts an engine output addition offset value 241, which is set as a constant value, from the previous engine target output D240 obtained in the previous processing. Note that, the previous engine target output D240 is the engine target output D240 previously processed and output, which is then input via a delay circuit 240. In a subtracting unit 244 obtains a deviation by subtracting the engine actual output D401 which is obtained, with consideration on latch output, in the engine actual output latching function block 302 from the subtracted value obtained above. A multiplying unit 245 multiplies the deviation and a certain gain (−Ki) to obtain a multiplied value. The integrating unit 246 integrates the multiplied value. The adding unit 247 adds the engine minimum output D220 obtained by processing in the engine minimum output processing block 120 to the integrated value. The minimum value selecting unit (select MIN) 248 outputs the minimum value of the added value and the engine maximum output D230 obtained by processing in the engine maximum output processing block 130, as the engine target output D240. The engine target output D240 is used as an engine output command value for engine control command as illustrated in FIG. 6. The engine target output D240 represents engine output command value curves EL1 and EL3 as illustrated in FIG. 3 to FIG. 5.

An engine actual output processing block 242 obtains the engine actual output D400 by processing using the equation expressed below based on engine torque D106 estimated from a fuel injection amount which is commanded by the engine controller 30, the engine speed, atmospheric temperature, or the like and the engine speed D107 detected by the engine speed sensor which is not shown in the drawing.

$$\text{engine actual output (kW)} = 2\pi/60 \times \text{engine speed} \times \text{engine torque}/1000$$

The obtained engine actual output D400 is output to the engine actual output latching function block 302. As described above, the engine actual output latching function block 302 processes the engine actual output D401 considering the latch output.

Further, the engine output decrease allowing information generating block 301 generates an engine output decrease allowing information based on the lever value signal (lever manipulation amount total sum) D100, the pump pressures D104 and D105, and an single touch power-up signal D108. The engine output decrease allowing information generating block 301 outputs the engine output decrease allowing information to the engine actual output latching function block 302 and the integrating unit 246. The engine output decrease allowing information allows decrease in the engine output during the period in which the lever manipulation amount total sum of the manipulating lever is decreasing. Specifically, the engine output decrease allowing information is a lever manipulation amount total sum decrease flag D300. The engine output decrease allowing information generating block 301 carries out processing of setting the lever manipulation amount total sum decrease flag D300 during a period in which the lever manipulation amount total sum D100 of the manipulating lever is decreasing. The lever manipulation amount total sum D100 is output to the engine actual output latching function block 302 and the integrating unit 246. The engine output decrease allowing information is not limited to a flag such as the lever manipulation amount total sum decrease flag D300 as described above. The engine output decrease allowing information may be a signal which allows decrease in the engine output, or may be configured to output data which allows decrease in the engine output. In the following, description will be made using the lever manipulation amount total sum decrease flag D300 as an example of the engine output decrease allowing information.

Lever Manipulation Amount Total Sum Decrease Flag Processing

Figure 11:
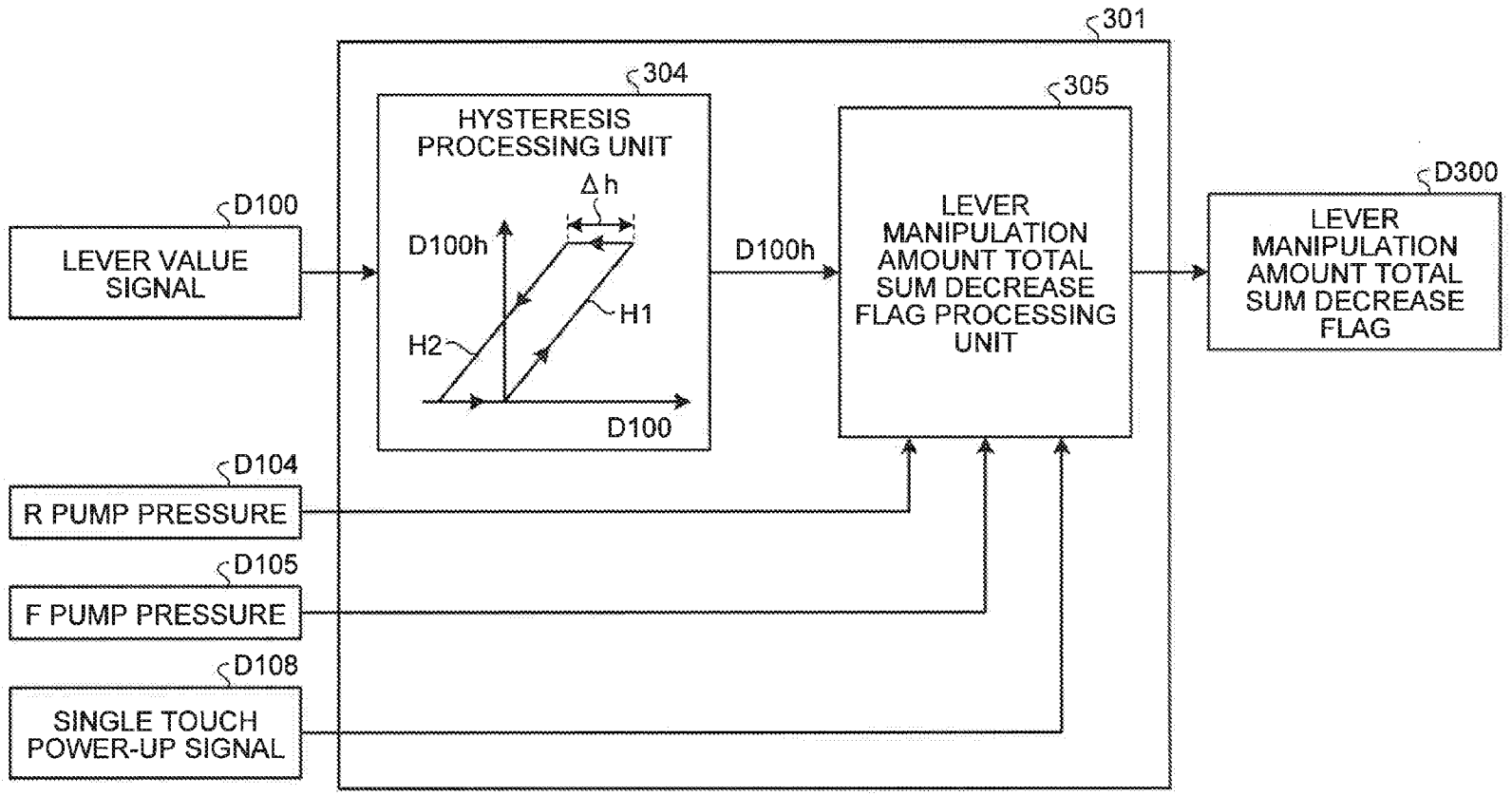
FIG. 11 is a figure illustrating a detailed control flow of a lever manipulation amount total sum decrease flag processing block illustrated in FIG. 10.

As illustrated in FIG. 11, the engine output decrease allowing information generating block 301 includes a hysteresis processing unit 304 and a lever manipulation amount total sum decrease flag processing unit 305.

Hysteresis Processing

As illustrated in FIG. 11, the hysteresis processing unit 304 has a hysteresis property in that a line H1 which allows the output of a lever manipulation amount total sum D100*h* to change only in the increasing-direction corresponding to the input of the lever manipulation amount total sum D100, and a line H2 which allows the output of the lever manipulation amount total sum D100*h* to change only in the decreasing-direction corresponding to the input of the lever manipulation amount total sum D100, are arranged displaced in the direction of the lever manipulation amount total sum D100 by a predetermined amount of the lever manipulation amount total sum D100, that is, Δh. Note that, the lever manipulation amount total sum D100 of the line H2 is smaller than the lever manipulation amount total sum D100 of the line H1 by the predetermined amount Δh.

When the input of the lever manipulation amount total sum D100 is on the line H1, the output of the lever manipulation amount total sum D100*h* is allowed to increase. In a case when the input of the lever manipulation amount total sum D100 decreases, only when an amount of decrease is equal to, or greater than, the predetermined amount Ah described above, it is recognized that the lever manipulation amount total sum D100 has decreased so that a changeover to the line H2 is made. Further, when the input of the lever manipulation amount total sum D100 is on the line H2, the output of the lever manipulation amount total sum D100*h* is allowed to decrease. In a case when the input lever manipulation amount total sum D100 increases, only when an amount of increase is equal to, or greater than, the predetermined amount Δh described above, it is recognized that the lever manipulation amount total sum D100 has increased so that a changeover to the line H1 is made. The hysteresis processing unit 304 outputs the lever manipulation amount total sum D100*h* produced through conversion by the hysteresis profile to the lever manipulation amount total sum decrease flag processing unit 305. Note that, when the lever manipulation amount total sum D100 is on the line H1, the lever manipulation amount total sum D100 is in an increasing state in which the lever manipulation amount total sum decrease flag D300 is "FALSE", that is, a flag is set. Further, when the lever manipulation amount total sum D100 is on the line H2, the lever manipulation amount total sum D100 is in a decreasing state, in which the lever manipulation amount total sum decrease flag D300 is "TRUE", that is, a flag is cancelled. That is, in the hysteresis processing, when the lever manipulation amount total sum decrease flag is not set and the amount of change in the decreasing-direction of the lever manipulation amount total sum is equal to, or greater than, the predetermined amount Δh, the lever manipulation amount total sum decrease flag is set. And when the lever manipulation amount total sum decrease flag is set and the amount of change in the increasing-direction of the lever manipulation amount total sum is equal to, or greater than, the predetermined amount, the lever manipulation amount total sum decrease flag is cancelled. By such hysteresis processing, frequent fluctuation of the state of the lever manipulation amount total sum decrease flag D300, that is, a so-called chattering can be prevented.

Lever Manipulation Amount Total Sum Decrease Flag Processing

Figure 12:
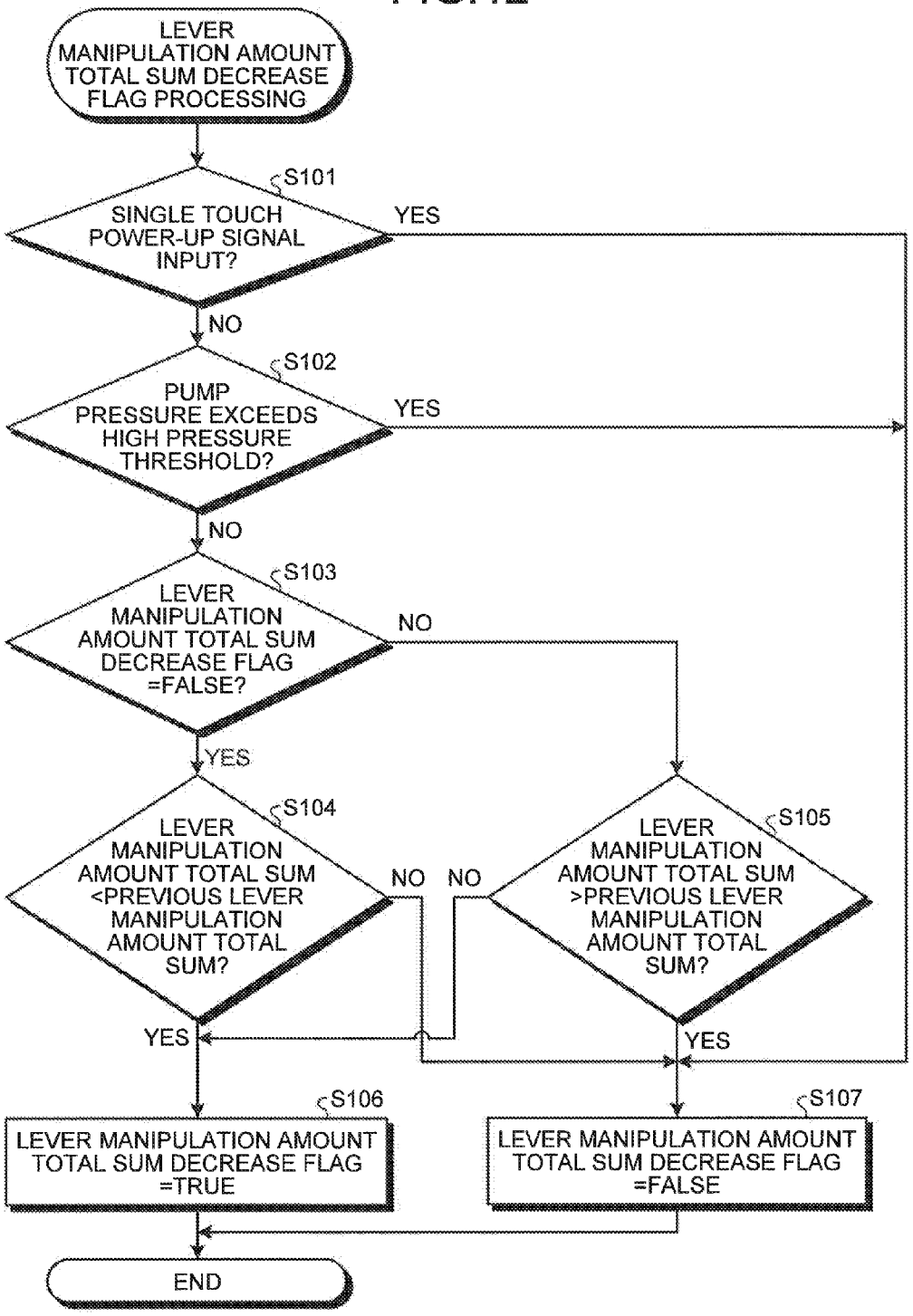
FIG. 12 is a flowchart illustrating a processing procedure of a lever manipulation amount total sum decrease flag processing unit illustrated in FIG. 11.

The lever manipulation amount total sum decrease flag processing unit 305 carries out processing whether the lever manipulation amount total sum decrease flag D300 is to be set. As illustrated in FIG. 12, at first, in the processing, a decision is made whether a single touch power-up signal D108 is input (step S101). When the single touch power-up signal D108 is input (YES in step S101), the lever manipulation amount total sum decrease flag D300 is set as "FALSE" (step S107). In this case, the lever manipulation amount total sum decrease flag D300 is set as "FALSE" because it is necessary to set a high engine target output when a single touch power-up is required.

Further, when a single touch power-up signal D108 is not input (NO in step S101), further decision is made whether the pump pressures D104 and D105 have exceeded a high pressure threshold value Pth (step S102). The high pressure threshold value Pth is, for example, close to a value representing a relief state. When the pump pressures D104 and D105 exceed the high pressure threshold value Pth (YES in step S102), the lever manipulation amount total sum decrease flag D300 is set as "FALSE" (step S107). In this case, the lever manipulation amount total sum decrease flag D300 is set as "FALSE" because it is necessary to set a high engine target output when the pump pressure is high.

When the pump pressures D104 and D105 do not exceed the high pressure threshold value Pth (NO in step S102), further decision is made whether the lever manipulation amount total sum decrease flag D300 is "FALSE" (step S103). When the lever manipulation amount total sum decrease flag D300 is "FALSE" (YES in step S103), a decision is made whether the lever manipulation amount total sum decrease flag D300 is smaller than the previous lever manipulation amount total sum decrease flag D300 (step S104). Then, when the lever manipulation amount total sum decrease flag D300 is smaller than the previous lever manipulation amount total sum decrease flag D300 (YES in step S104), the lever manipulation amount total sum decrease flag D300 is set as "TRUE" (step S106). Further, when the lever manipulation amount total sum decrease flag D300 is not smaller than the previous lever manipulation amount total sum decrease flag D300 (NO in step S104), the lever manipulation amount total sum decrease flag D300 is set as "FALSE" (step S107).

Further, when the lever manipulation amount total sum decrease flag D300 is not "FALSE" (NO in step S103), a decision is made whether the lever manipulation amount total sum decrease flag D300 is greater than the previous lever manipulation amount total sum decrease flag D300 (step S105). When the lever manipulation amount total sum decrease flag D300 is greater than the previous lever manipulation amount total sum decrease flag D300 (YES in step S105), the lever manipulation amount total sum decrease flag D300 is set as "FALSE" (step S107). Further, when the lever manipulation amount total sum decrease flag D300 is not greater than the previous lever manipulation amount total sum decrease flag D300 (NO in step S105), the lever manipulation amount total sum decrease flag D300 is set as "TRUE" (step S106). These set lever manipulation amount total sum decrease flags D300 are output to the engine actual output latching function block 302 and the integrating unit 246.

Engine Actual Output Latching Function Processing

Figure 13:
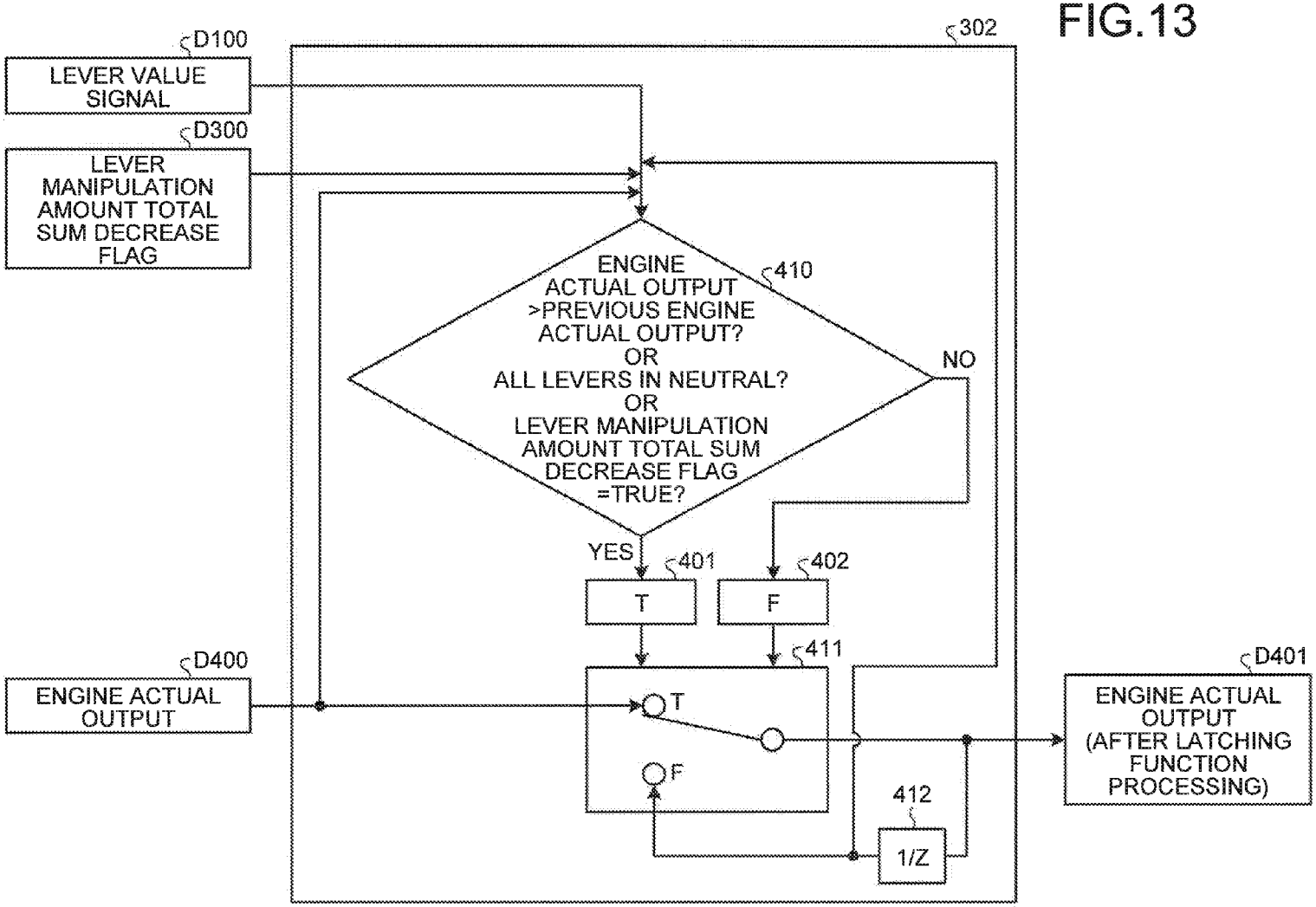
FIG. 13 is a figure illustrating a detailed control flow of an engine actual output latching function block illustrated in FIG. 10.

As illustrated in FIG. 13, in the engine actual output latching function block 302, firstly, a decision unit 410 decides whether the input of the engine actual output D400 exceeds the previous engine actual output D401 which is input via a delay circuit 412. Further, the decision unit 410 decides whether all the levers are in neutral by the lever value signal D100. Further, the decision unit 410 decides whether the lever manipulation amount total sum decrease flag D300 is "TRUE".

In either of the cases when the input of the engine actual output D400 exceeds the previous engine actual output D401 which is input via the delay circuit 412, when all the levers are in neutral, or when the lever manipulation amount total sum decrease flag D300 is "TRUE", a processing unit 401 carries out processing of connecting a selector switch 411 to a "T" terminal. In other cases, a processing unit 402 connects the selector switch 411 to the "F" terminal. The engine actual output D400 is input to the "T" terminal and the previous engine actual output D401 is input to the "F" terminal.

Consequently, the engine actual output latching function block 302 latches and outputs the previous engine actual output D401 in the case when all the levers are not in neutral, the lever manipulation amount total sum decrease flag D300 is "FALSE", that is, in an increasing state in which the flag is cancelled, and the engine actual output D400 is equal to, or smaller than, the previous engine actual output D401 and not increasing. In other cases, the engine actual output latching function block 302 outputs the input of the engine actual output D400.

Integration Processing of Integrating Unit

Figure 14:
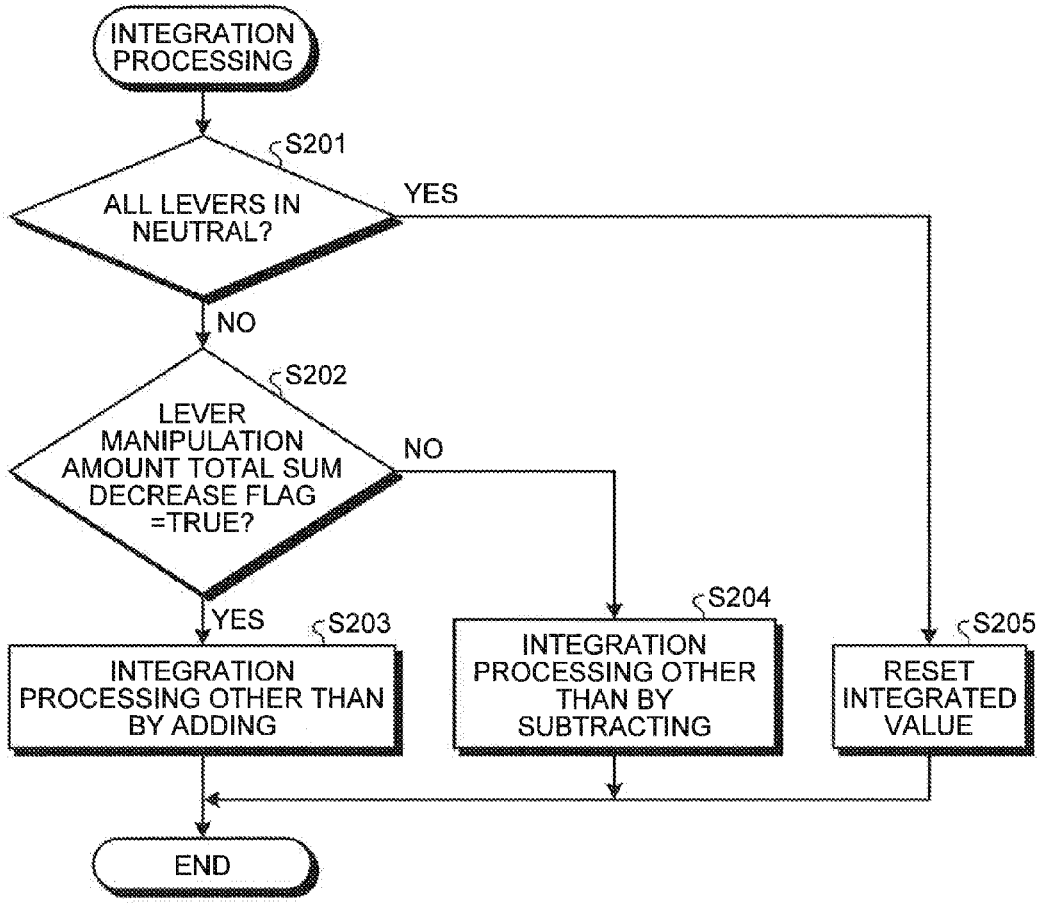
FIG. 14 is a flowchart illustrating an integration processing procedure of an integrating unit illustrated in FIG. 10.

Now, the integration processing of the integrating unit 246 will be described. AS illustrated in FIG. 14, in the integration processing of the integrating unit 246, at first, a decision is made whether all the levers are in neutral (step S201). When all the levers are in neutral (YES in step S201), an integrated value is reset (step S205).

When not every lever is in neutral (NO in step S201), a decision is made whether the lever manipulation amount total sum decrease flag D300 is "TRUE" (step S202). When the lever manipulation amount total sum decrease flag D300 is "TRUE" (YES in step S202), the integration by adding is not carried out but the integration processing other than by adding is carried out (step S203). Further, when the lever manipulation amount total sum decrease flag D300 is not "TRUE" (NO in step S202), the integration by subtraction is not carried out but the integration processing other than by subtraction is carried out (step S204). In such integration processing, when the lever manipulation amount total sum is increasing, the engine target output will not decrease. Further, when the lever manipulation amount total sum is decreasing, the engine target output will not increase. Particularly, since the engine target output does not increase when the lever manipulation amount total sum is decreasing, a waste of energy consumption can be eliminated.

Example of Engine Target Output Processing (1)

Figure 15:
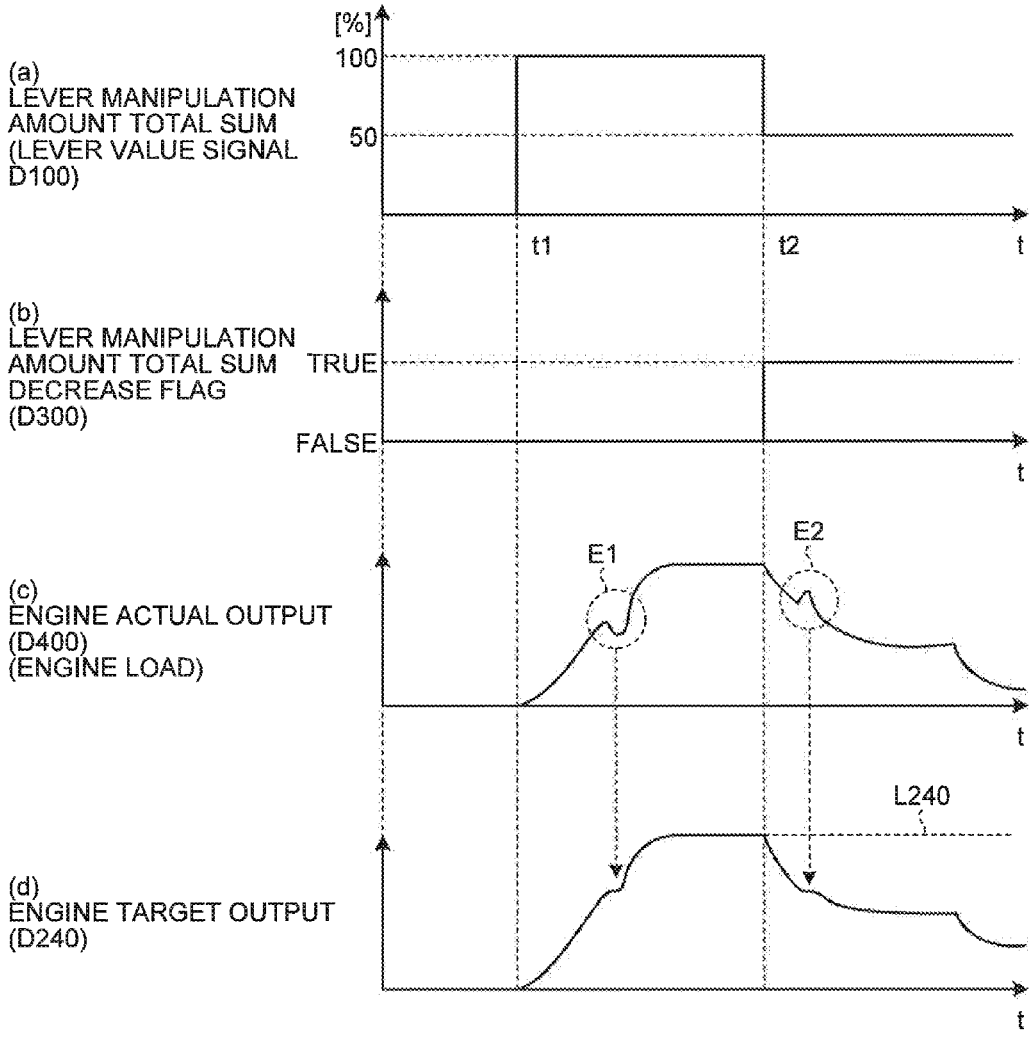
FIG. 15 is a timing diagram illustrating an example of the engine target output using the lever manipulation amount total sum decrease flag.

Referring to a timing diagram illustrated in FIG. 15, an example of the engine target output processing will be described. As illustrated in FIG. 15, when the lever manipulation amount total sum reaches 100% at a point of time t1, the engine actual output D400 gradually increases. Then, the engine target output D240 also increases, instead of decreasing by the engine actual output latching function block 302 or the like. Particularly, even when the engine actual output D400 drops for a very short period of time within a region E1, the engine target output D240 does not decrease but keeps the previous engine target output.

Then, at a point of time t2 when the lever manipulation amount total sum decreases to 50%, the engine output decrease allowing information generating block 301 sets the lever manipulation amount total sum decrease flag D300 to be "TRUE" to set the flag and the engine actual output D400 starts to decrease. The engine target output D240 also decreases instead of increasing by the engine actual output latching function block 302 or the like. Particularly, even when the engine actual output D400 increases for a very short period of time within a region E2, the engine target output D240 does not increase but keeps the previous engine target output. Note that, in a conventional engine control apparatus, as in a line L240 illustrated in FIG. 15(*d*), the engine target output does not decrease even when decreasing of the lever manipulation amount total sum causes the engine actual output D400 to decrease. Therefore, as described above, the engine speed is kept in a high engine speed state, which does not allow improvement in the fuel consumption rate.

As described above, the engine target output D240 is set according to the engine actual output D400. As described above using FIG. 4, when the lever manipulation amount total sum decreases, the engine target output D240 is set to be small according to the decrease in the engine actual output D400, thereby reducing the engine speed, which enables improvement in fuel consumption rate. Further, the engine target output D240 decreases according to the decrease in the engine actual output D400 caused by decreasing the lever manipulation amount total sum. Therefore even when the engine actual output D400 increases for a very short period of time, the engine target output D240 will not increase, so that deterioration in the fuel consumption rate can be prevented.

Example of Engine Target Output Processing (2)

Figure 16:
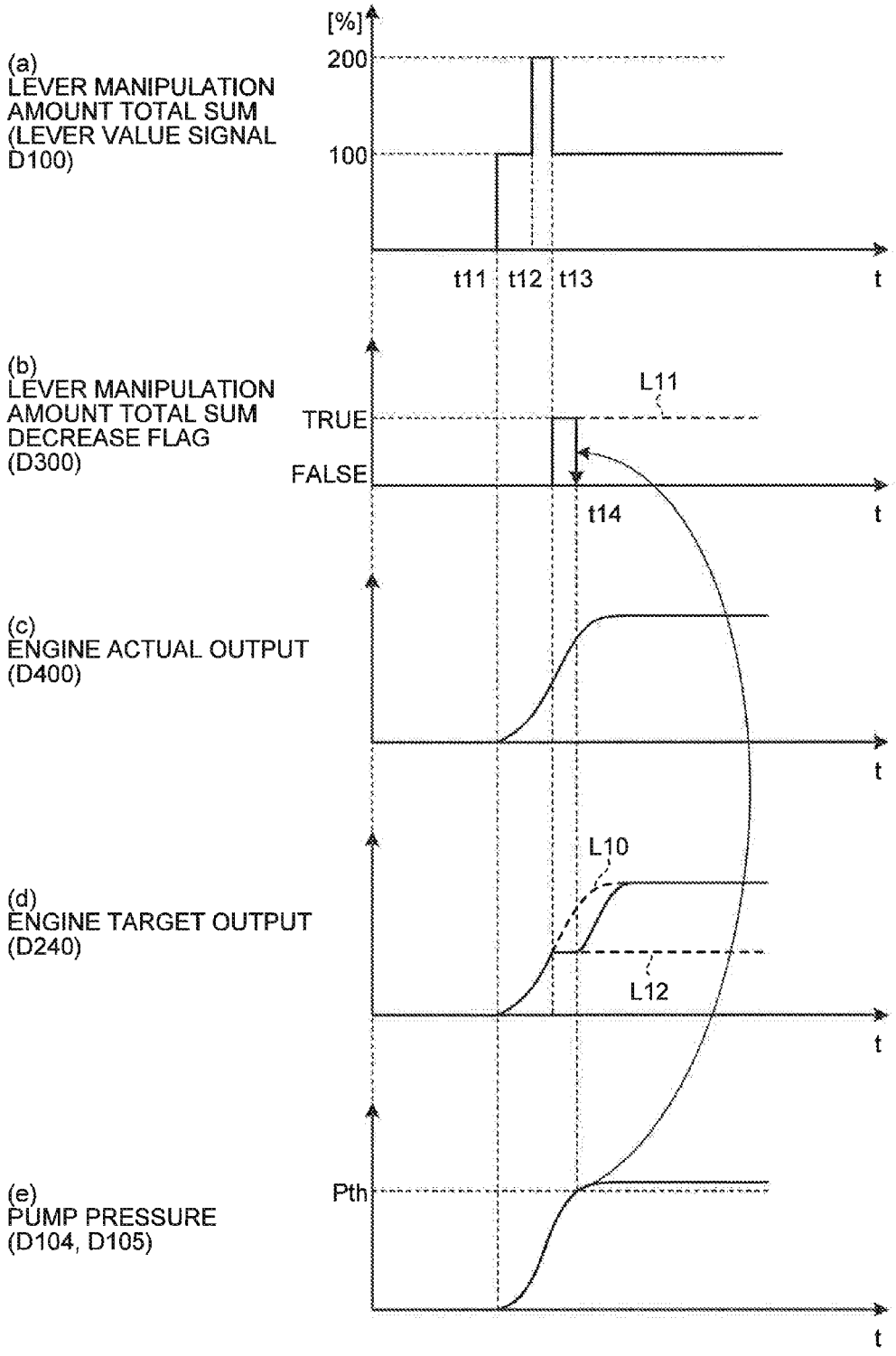
FIG. 16 is a timing diagram illustrating an example of the engine target output using the lever manipulation amount total sum decrease flag.

Now, referring to a timing chart illustrated in FIG. 16, another example of the engine target output processing will be described. In FIG. 16, the lever manipulation amount total sum reaches 100% at a point of time t11, then the lever manipulation amount total sum increases to 200% at a point of time t12, and then the lever manipulation amount total sum returns to 100% again at a point of time t13. Such situation occurs, for example, when the boom 11 is operated at the point of time t11 and the bucket 13 is operated, by misoperation or the like, during the period between the point of times t12 and t13.

Also in this case, the lever manipulation amount total sum decrease flag D300 is set to be "TRUE" to set the flag at the point of time t13. However, when the pump pressures D104 and D105 exceed the high pressure threshold Pth at a point of time t14, the lever manipulation amount total sum decrease flag D300 is set to be "FALSE" to cancel the flag. As a result, the engine target output D240 increases from the point of time t14.

In such situation, the state of the lever manipulation amount total sum is 100% at the point of time t11 so that the pump pressure is also close to the relief state. The decreasing of the engine target output under such condition in which the lever manipulation amount total sum is 100% is against the intention of an operator. Therefore, it is configured that when the pump pressure exceeds the high pressure threshold Pth, a high engine actual output D400 is output as the engine target output corresponding to the intention of the operator. In this case, it is configured that the engine target output D240 shows followability which is the profile almost the same as a curve L10 representing the engine target output under the state when the lever manipulation amount total sum decrease flag D300 is not set, so that a high engine actual output can be obtained. Note that, when a "TRUE" cancelling processing for the lever manipulation amount total sum decrease flag D300 by the high pressure threshold Pth of the pump pressure is not carried out, the lever manipulation amount total sum decrease flag D300 keeps the "TRUE" state as illustrated in a line L11 in FIG. 16(*b*). As a result, the engine target output D240 also does not increase as in a line L12 illustrated in FIG. 16(*d*). Thereby, the high engine actual output D400 cannot be obtained.

Figure 17:
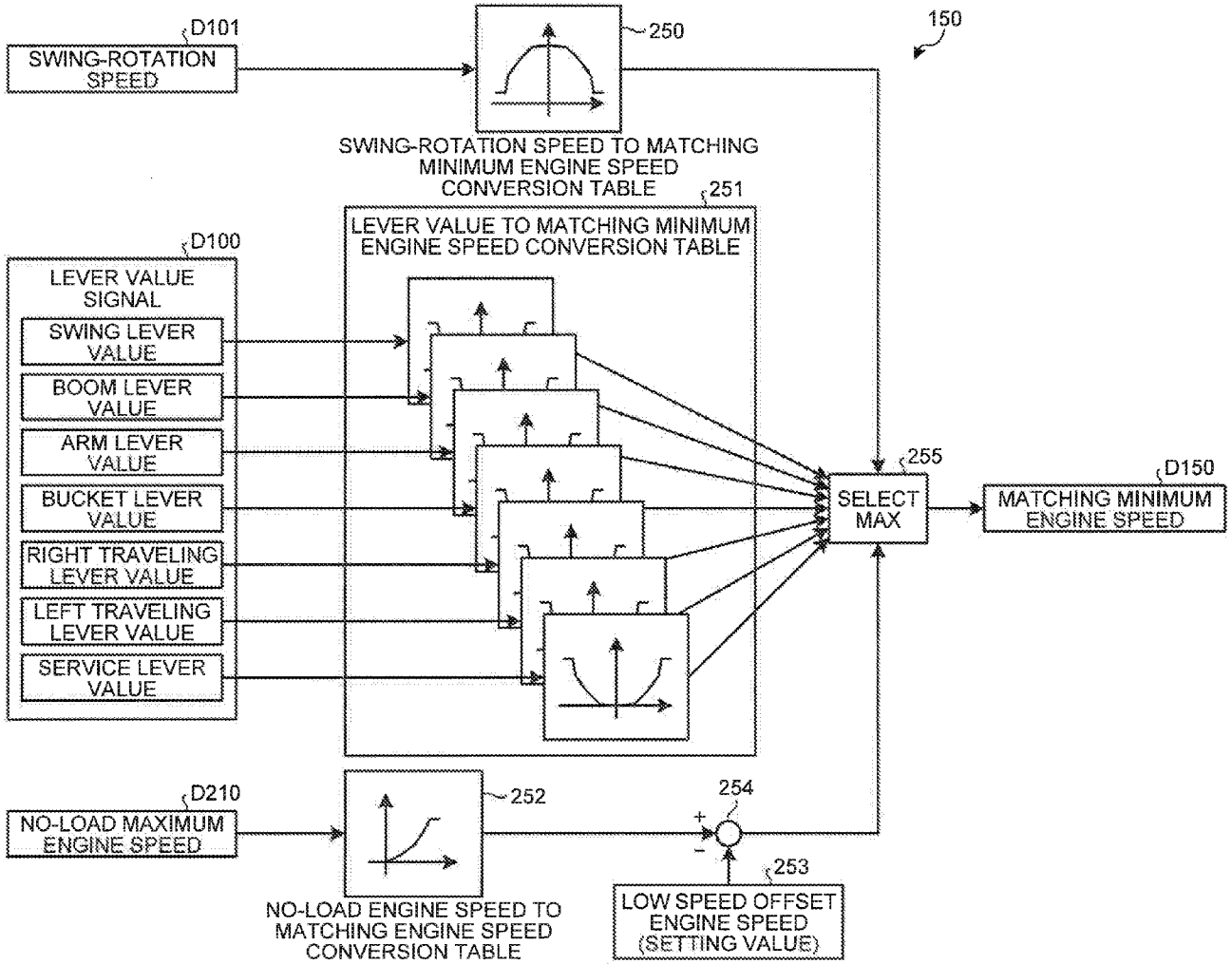
FIG. 17 is a figure illustrating a detailed control flow of a matching minimum engine speed processing block illustrated in FIG. 6.

Now, a detailed control processing of a matching minimum engine speed processing block 150 illustrated in FIG. 6 will be described. As illustrated in FIG. 17, the matching minimum engine speed processing block 150 processes the matching minimum engine speed D150, that is, a minimal engine speed by which the engine speed need to be increased during work. As for the matching minimum engine speed D150, each value produced by converting each lever value signal D100 by a lever value to matching minimum engine speed conversion table 251 is a candidate value for the matching minimum engine speed D150 and output to the maximum value selecting unit (select MAX) 255, respectively.

Figure 21:
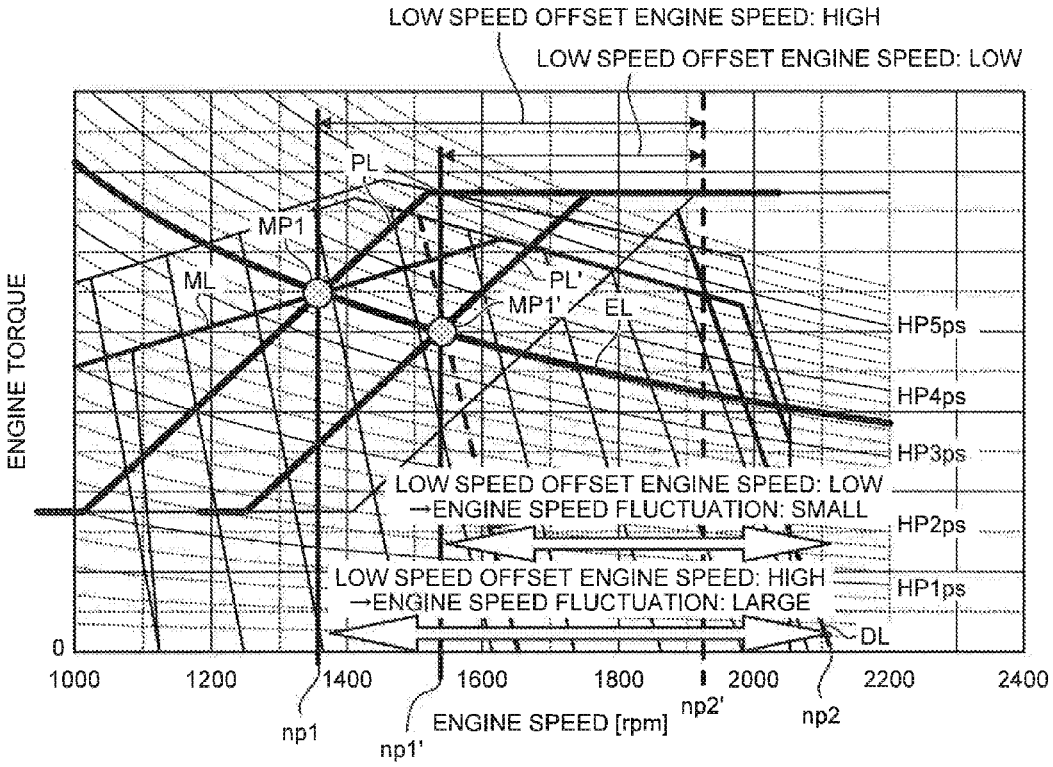
FIG. 21 is a torque line chart explaining a detail of engine control of the engine controller or the pump controller.

Further, similar to the target matching engine speed np1, a no-load engine speed to matching engine speed conversion table 252 converts the no-load maximum engine speed D210 (np2) obtained in the no-load maximum engine speed processing block 110 and outputs an engine speed at the intersection point of the droop line DL which crosses a no-load maximum engine speed np2 and the target matching route ML as a matching engine speed np2' (see FIG. 21). Further, a low speed offset engine speed 253 is subtracted from the matching engine speed np2', and the value obtained thereby is output to the maximum value selecting unit (select MAX) 255 as a candidate value for the matching minimum engine speed D150. The concept of using the low speed offset engine speed 253 and the magnitude of the value thereof will be described below.

Further, the swing-rotation speed to matching minimum engine speed conversion table 250 converts the swing-rotation speed D101 into a candidate value for the matching minimum engine speed D150 and outputs the matching minimum engine speed D150 to the maximum value selecting unit 255. The swing-rotation speed D101 is a value detected from a swing-rotation speed (speed) of the swing hydraulic motor 31 in FIG. 2 by a rotation sensor such as a resolver or a rotary encoder. Note that, the swing-rotation speed to matching minimum engine speed conversion table 250 converts the swing-rotation speed D101 with a profile in which, as illustrated in FIG. 17, a high matching minimum engine speed is provided when the swing-rotation speed D101 is zero and a smaller matching minimum engine speed is provided as the swing-rotation speed D101 increases. The maximum value selecting unit 255 selects the maximum value among these matching minimum engine speeds and outputs the maximum value as the matching minimum engine speed D150.

In the embodiment, when the load drops, the engine speed increases, at the greatest, to the no-load maximum engine speed np2. When a sufficient load is applied, the engine speed decreases to the target matching engine speed np1. In this case, the engine speed widely fluctuates according to the magnitude of load. The wide fluctuation of the engine speed might be felt by the operator of the excavator 1 as an unusual feeling that the excavator 1 lacks power (feeling of lack of power). Therefore, as illustrated in FIG. 21, such unusual feeing can be removed by using a low speed offset engine speed, that is, by changing the range of fluctuation of the engine speed according to the magnitude of the low speed offset engine speed which is to be set. Which means, when the low speed offset engine speed is set to be low, the range of fluctuation of the engine speed is decreased, and when the low speed offset engine speed is set to be high, the range of fluctuation of the engine speed increases. Note that, depending on a working state of the excavator 1, such as a state in which the upper swing body 5 is swinging or a state in which the work machine 3 is performing excavation work, the unusual feeling which the operator feels differs even under the same range of fluctuation of the engine speed. In the state in which the upper swing body 5 is swinging, even when the engine speed decreases by a certain amount, it is likely, compared to the state when the work machine 3 is performing excavation work, that the operator does not feel a lack of power. Therefore, under the state in which the upper swing body 5 is swinging, there is no problem to set the engine speed to decrease to be further lower than the state in which the work machine 3 is performing excavation work. In this case, the fuel consumption rate improves because the engine speed decreases. Note that, similar setting of the range of fluctuation of the engine speed can be provided according to the motion of other actuators other than the swinging.

Figure 25:
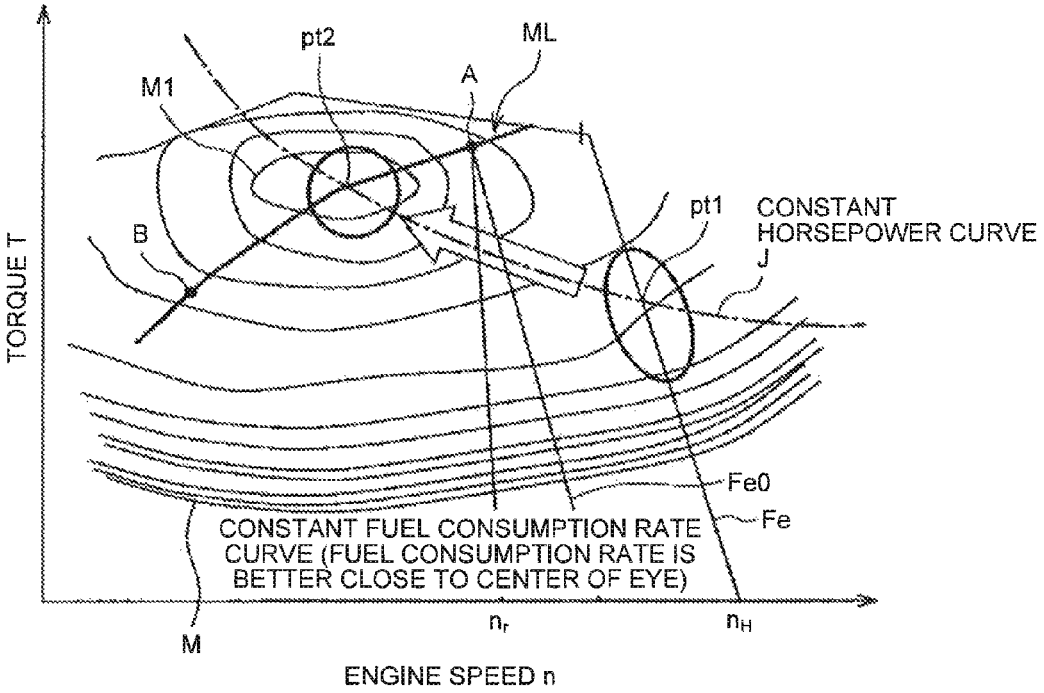
FIG. 25 is a torque line chart explaining conventional engine control using a target matching route.

Supplementary description of a torque line chart illustrated in FIG. 21 will be made. HP1 to HP5 illustrated in the chart in FIG. 21 correspond to a constant horsepower curve J illustrated in FIG. 25, in which ps represents a unit of horsepower (ps), and the horsepower is greater as the curve proceeds from HP1 to HP5. Five curves in the chart are illustrated as an example. By the required engine output command value, the constant horsepower curve (engine output command value curve) EL is required and set. Therefore, the constant horsepower curve (engine output command value curve) EL is not limited to five curves, that is, HP1 to HP5. Unlimited number of curves exist and the constant horsepower curve (engine output command value curve) EL is selected from such curves. FIG. 21 illustrates a case in which the constant horsepower curve (engine output command value curve) EL which represents a horsepower between HP3 *ps* and HP4 *ps* is required and set.

Figure 18:
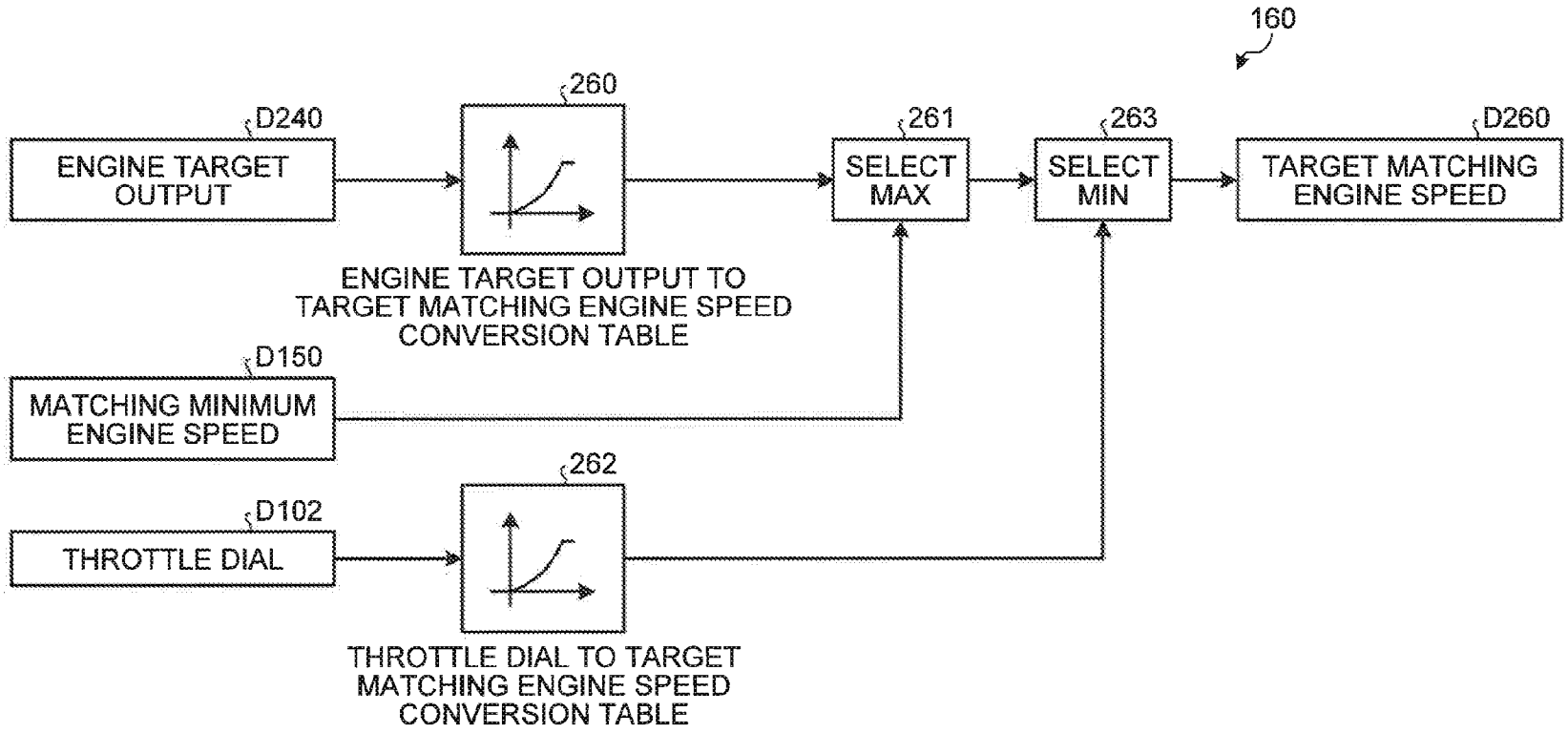
FIG. 18 is a figure illustrating a detailed control flow of a target matching engine speed processing block illustrated in FIG. 6.

FIG. 18 is a detailed control flow of a target matching engine speed processing block 160. As illustrated in FIG. 18, the target matching engine speed processing block 160 processes the target matching engine speed np1 (D260) illustrated in FIG. 5. The target matching engine speed D260 is an engine speed at the intersection of the engine target output D240 (engine output command value curve EL) and the target matching route ML. The target matching route ML is provided so that the engine 17 operates at a certain engine output tracing the point which gives preferable fuel consumption rate. Therefore, it is preferable to determine the target matching engine speed D260 at the intersection point of the target matching route ML and the engine target output D240. For this, in an engine target output to target matching engine speed conversion table 260, on receiving the input of the engine target output D240 (engine output command value curve EL) required in the engine target output processing block 140, the target matching engine speed at the intersection point of the engine target output D240 (engine output command value curve EL) and the target matching route ML is obtained and output to the maximum value selecting unit (select MAX) 261.

However, according to the processing carried out in the matching minimum engine speed processing block 150 illustrated in FIG. 17, when the range of fluctuation of the engine speed is set to be small, the matching minimum engine speed D150 becomes higher than the matching engine speed obtained in the engine target output to target matching engine speed conversion table 260. Therefore, the matching minimum engine speed D150 and the matching engine speed obtained from the engine target output D240 are compared in the maximum value selecting unit (select MAX) 261 so as to select the maximum value as a candidate value for the target matching engine speed D260, thereby limiting the lower limit of the target matching engine speed. In FIG. 21, when the low speed offset engine speed is set to be small, deviation from the target matching route ML occurs, so that MP1', not MP1, becomes the target matching point, and np1', not np1, becomes the target matching engine speed D260. Further, similar to the no-load maximum engine speed D210 obtained in the no-load maximum engine speed processing block 110, the upper limit of the target matching engine speed D260 is also limited by the setting value of the fuel adjustment dial 28 (throttle dial D102). That is, on receiving the input of the setting value of the fuel adjustment dial 28 (throttle dial D102), a throttle dial to target matching engine speed conversion table 262 outputs a candidate value for the target matching engine speed D260 produced by converting the input into the matching engine speed at the intersection point of the droop line corresponding to the setting value of the fuel adjustment dial 28 (throttle dial D102), that is, a droop line which can be drawn from the engine speed corresponding to the setting value of the fuel adjustment dial 28 (throttle dial D102) in the torque line chart, and the target matching route ML. The candidate value of the target matching engine speed D260 which is output and the candidate value of the target matching engine speed D260 selected in the maximum value selecting unit 261 are compared in the minimum value selecting unit (select MIN) 263 so as to select the minimum value, thereby outputting the final target matching engine speed D260.

Figure 19:
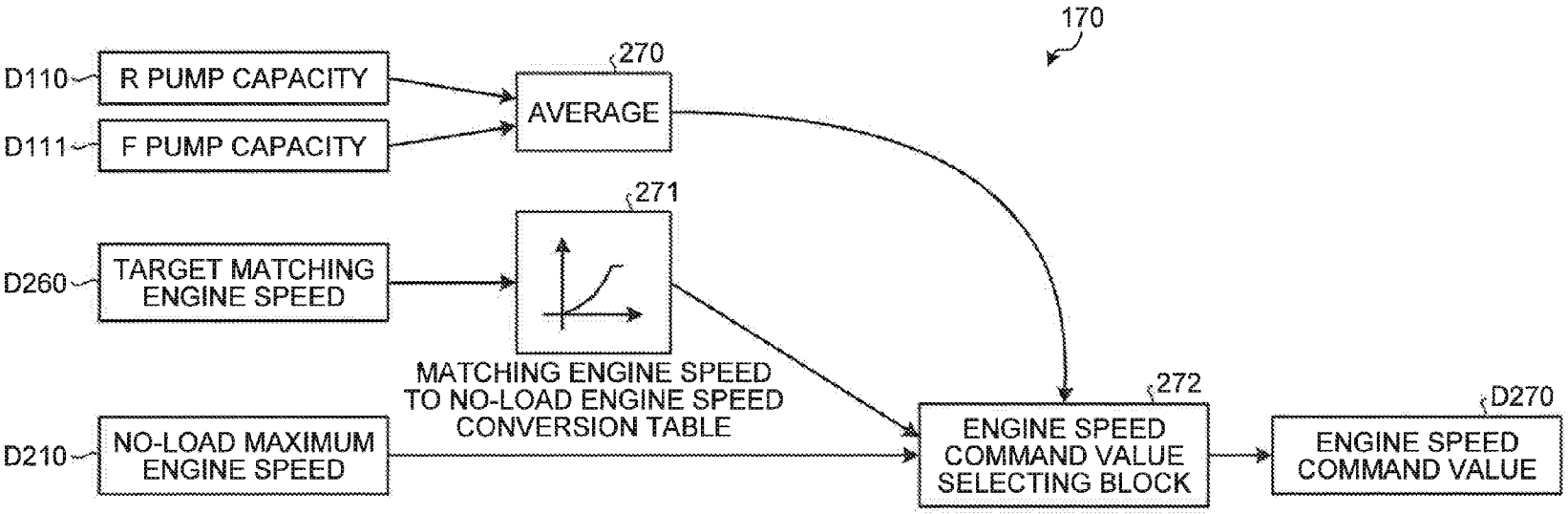
FIG. 19 is a figure illustrating a detailed control flow of an engine speed command value processing block illustrated in FIG. 6.

FIG. 19 is a detailed control flow of an engine speed command value processing block 170. Description will be made below referring to a torque line chart illustrated in FIG. 5. As illustrated in FIG. 19, in the engine speed command value processing block 170, based on pump capacities D110 and D111 which are obtained based on swash plate angles detected by the swash plate angle sensors 18*a* of two hydraulic pumps 18, an averaging unit 270 calculates an average of the pump capacities D110 and D111 to obtain an average pump capacity. According to the magnitude of the average pump capacity, an engine speed command value selecting block 272 obtains an engine speed command value D270 (no-load maximum engine speed np2). That is, when the average pump capacity is greater than a certain setting value (threshold value), the engine speed command value selecting block 272 tries to set an engine speed command value D270 closer to the no-load maximum engine speed np2 (D210). Which means that the engine speed increases. Further, when the average pump capacity is smaller than a certain setting value, the engine speed is decreased so as the engine speed to be closer to an engine speed nm1 which will be described below. The engine speed nm1 is obtained by adding a lower limit engine speed offset value Δnm to a no-load engine speed np1*a* which is an engine speed corresponding to a point which is obtained by drawing a droop line, toward zero engine torque, from the intersection point of the target matching engine speed np1 (D260) and the torque on the target matching point MP1. Note that, the conversion to the no-load engine speed corresponding to the target matching engine speed D260 is carried out by a matching engine speed to no-load engine speed conversion table 271. Therefore, the engine speed command value D270 is determined between the no-load minimum engine speed nm1 and the no-load maximum engine speed np2 according to the state of the pump capacity. The lower limit engine speed offset value Δnm is a predetermined value and stored in a memory of the engine controller 30.

To describe specifically, when the average pump capacity is larger than a setting value q_com1, the engine speed command value D270 is set to be close to the no-load maximum engine speed np2, and when the average pump capacity is smaller than the setting value q_com1, the engine speed command value D270 is set to be close to a required value using an equation expressed below.

engine speed command value $D270$=engine speed $np1a$ obtained by converting target matching engine speed $np1$ into no-load engine speed+lower limit engine speed offset value $\Delta nm$ The droop line can be controlled by the engine speed command value D270 thus obtained. When there is a margin in the pump capacity (when the average pump capacity is smaller than a certain setting value), the engine speed can be decreased (set the engine speed to nm1 (no-load minimum engine speed)) as illustrated in FIG. 5, thereby enabling to suppress the fuel consumption rate to improve the consumption rate. The setting value q_com1 is a predetermined value and stored in a memory of the pump controller 33. Note that, for the setting value q_com1, two different setting values may be provided, each for the engine speed increasing side and the engine speed decreasing side, so as to provide a range in which the engine speed does not change.

Figure 20:
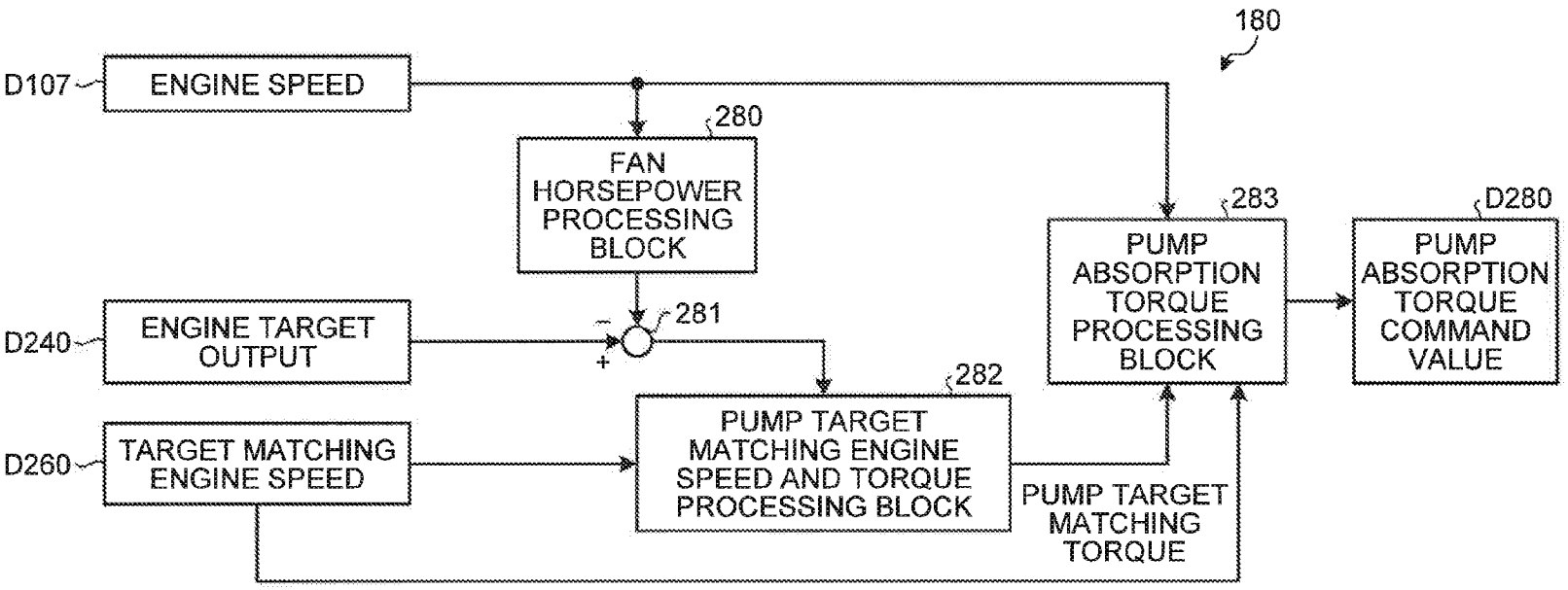
FIG. 20 is a figure illustrating a detailed control flow of a pump absorption torque command value processing block illustrated in FIG. 6.

FIG. 20 is a detailed control flow of a pump absorption torque command value processing block 180. As illustrated in FIG. 20, the pump absorption torque command value processing block 180 obtains a pump absorption torque command value D280 using the present engine speed D107, an engine target output D240, and the target matching engine speed D260. A fan horsepower processing block 280 processes the fan horsepower using the engine speed D107. Note that, the fan horsepower is obtained using the equation described above. A subtracting unit 281 subtracts the obtained fan horsepower from the engine target output D240 obtained in the engine target output processing block 140 to obtain an output (pump target absorption horsepower). The subtracting unit 281 inputs the output to a pump target matching engine speed and torque processing block 282. To the pump target matching engine speed and torque processing block 282, the target matching engine speed D260 obtained in the target matching engine speed processing block 160 is further input. The target matching engine speed D260 is determined to be the target matching engine speed of the hydraulic pump 18 (pump target matching engine speed). Then, a process described in an equation expressed below is carried out in the pump target matching engine speed and torque processing block 282.

pump target matching torque=(60×1000×(engine target output−fan horsepower))/(2π×target matching engine speed)

The obtained pump target matching torque is output to the pump absorption torque processing block 283.

To the pump absorption torque processing block 283, the pump target matching torque which is output from the pump target matching engine speed and torque processing block 282, the engine speed D107 detected by the rotation sensor, and the target matching engine speed D260 are input. In the pump absorption torque processing block 283, a processing described by an equation expressed below is carried out.

pump absorption torque=pump target matching torque−*Kp*×(target matching engine speed−engine speed)

The pump absorption torque command value D280 which is the result of the processing is output. Here, Kp is a control gain.

By execution of the control flow described above, when the actual engine speed D107 is higher than the target matching engine speed D260, the pump absorption torque command value D280 increases as can be understood by the equation expressed above. Contrarily, when the actual engine speed D107 is lower than the target matching engine speed D260, the pump absorption torque command value D280 decreases. Further, since the engine output is controlled so as the engine target output D240 to be the upper limit, consequently, the engine 17 is driven at the stable engine speed in the vicinity of the target matching engine speed D260.

In the engine speed command value processing block 170, as described above, the minimum value of the engine speed command value D270 becomes the value which is obtained by the processing as described below.

engine speed command value=engine speed *np*1*a* obtained by converting target matching engine speed *np*1 into no-load engine speed+lower limit engine speed offset value Δ*nm*

The engine droop line for the target matching engine speed is determined at a high engine speed range in which the lower limit engine speed offset value Δnm is at least added. Therefore, according to a first embodiment, even when the actual absorption torque of the hydraulic pump 18 (actual pump absorption torque) fluctuates against the pump absorption torque command by a certain amount, matching is carried out within a range not including the droop line. Even when the matching engine speed of the engine 17 fluctuates by a certain amount, the engine output is restricted by the engine output command value curve EL to control the engine target output to be constant. Therefore, when the actual absorption torque (actual pump absorption torque) fluctuates against the pump absorption torque command, the fluctuation of the engine output can be kept small. As a result, fluctuation of the fuel consumption rate can also be suppressed to be small, thereby allowing to comply with the specification of fuel consumption rate of the excavator 1.

Second Embodiment

The first embodiment is the example in which the present invention is applied to the excavator 1 having a configuration in which the upper swing body 5 swings by the hydraulic motor (swing hydraulic motor 31) and the work machine 3 is driven only by hydraulic cylinders 14, 15, and 16. Whereas, a second embodiment is an example in which the present invention is applied to the excavator 1 having a configuration in which the upper swing body 5 swings by an electric swing motor. The excavator 1 is described blow as a hybrid excavator 1. Hereinafter, the second embodiment has a common configuration to the first embodiment unless specifically noted.

Figure 22:
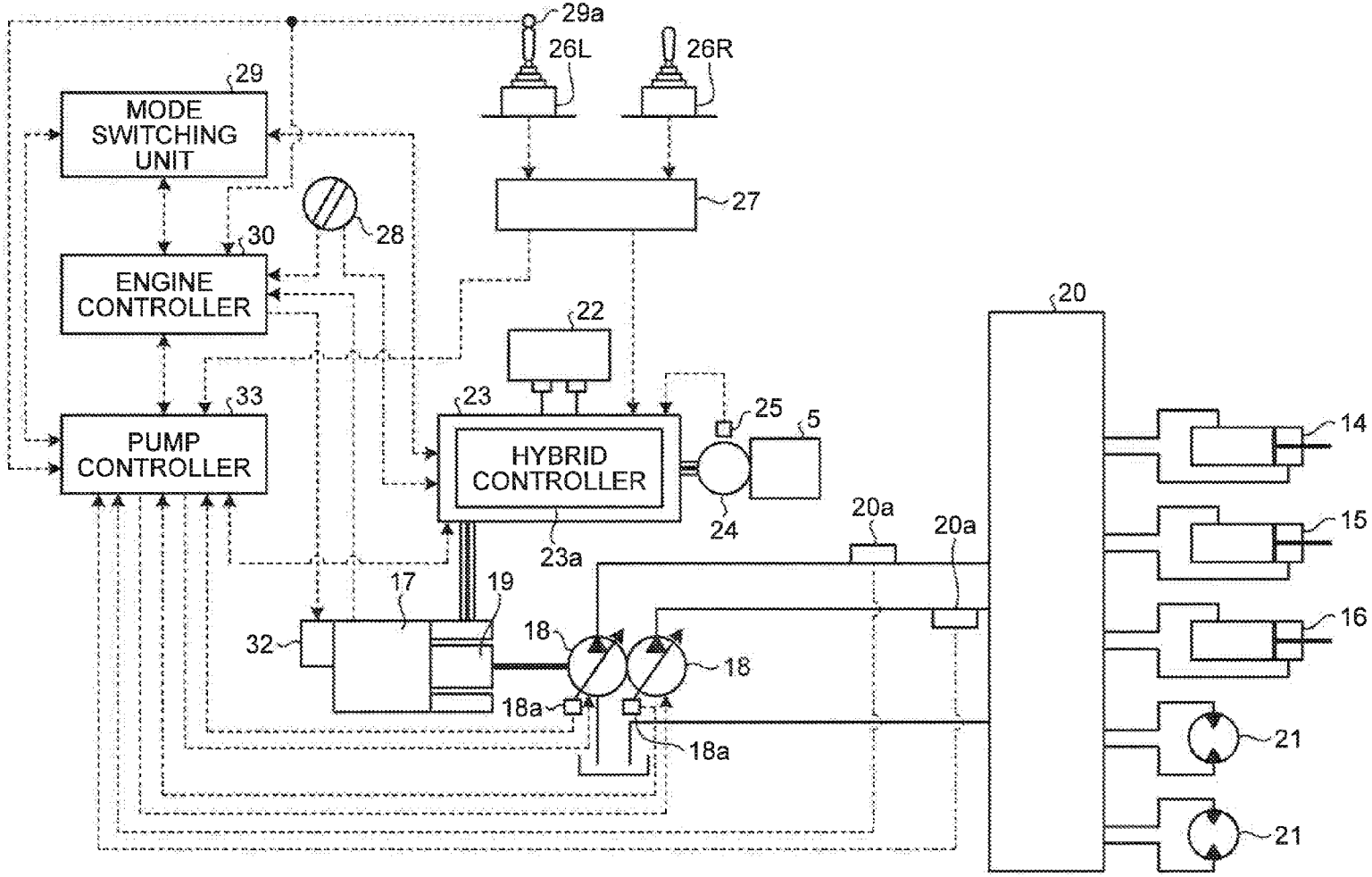
FIG. 22 is a schematic diagram illustrating a configuration of a control system of a hybrid excavator which is a second embodiment of the present invention.

The hybrid excavator 1 has the same main component such as the upper swing body 5, the bottom traveling body 4, and the work machine 3 compared to the excavator 1 illustrated in the first embodiment. However, in the hybrid excavator 1, as illustrated in FIG. 22, a generator 19 other than the hydraulic pump 18 is mechanically connected to the output shaft of the engine 17. The hydraulic pump 18 and the generator 19 are driven by driving the engine 17. Note that, the generator 19 may be mechanically direct-connected to the output shaft of the engine 17, and configured to be rotatably driven via a transmitting means such as a belt or a chain which is tied to the output shaft of the engine 17 and routed to the generator 19. Further, in place of the swing hydraulic motor 31 which is a hydraulic motor of the hydraulic-driving system, an electrically driven swing motor 24 is used, and together with the swing motor 24, a capacitor 22 and an inverter 23 are included as an electric-driving system. The power generated by the generator 19 or the power discharged from the capacitor 22 is supplied to the swing motor 24 via an electric cable to swing the upper swing body 5. That is, the swing motor 24 is swingably driven by powering effect of the electric energy supplied (generated) by the generator 19 or the electric energy supplied (discharged) by the capacitor 22. During slowdown of the swinging motion, the swing motor 24 produces regenerative effect to supply (charge) electric energy to the capacitor 22. As the generator 19, for example, an SR (switched reluctance) motor is used. The generator 19 is mechanically connected to the output shaft of the engine 17 so as that the rotor shaft of the generator 19 is rotated by driving the engine 17. As the capacitor 22, for example, an electric double layer capacitor is used. A nickel hydride metal battery or a lithium ion battery may be used in place of the capacitor 22. The rotation sensor 25 is provided to the swing motor 24, and detects and converts the rotational speed of the swing motor 24 into an electric signal. The rotation sensor 25 outputs the electric signal to a hybrid controller 23*a* provided in the inverter 23. As the swing motor 24, for example, a magnet embedded synchronous motor is used. As the rotation sensor 25, a resolver or a rotary encoder is used. Note that, the hybrid controller 23*a* is configured with a CPU (processing device such as a numeric data processor), a memory (storing device), or the like. On receiving a signal of a detected value detected by a temperature sensor such as a thermistor and a thermocouple provided in the generator 19, the swing motor 24, the capacitor 22, and the inverter 23, the hybrid controller 23*a* manages temperature rise of each equipment such as the capacitor 22 and also carries out charging/discharging control of the capacitor 22, generation/engine-assist control of the generator 19, and powering/regeneration control of the swing motor 24.

Figure 23:
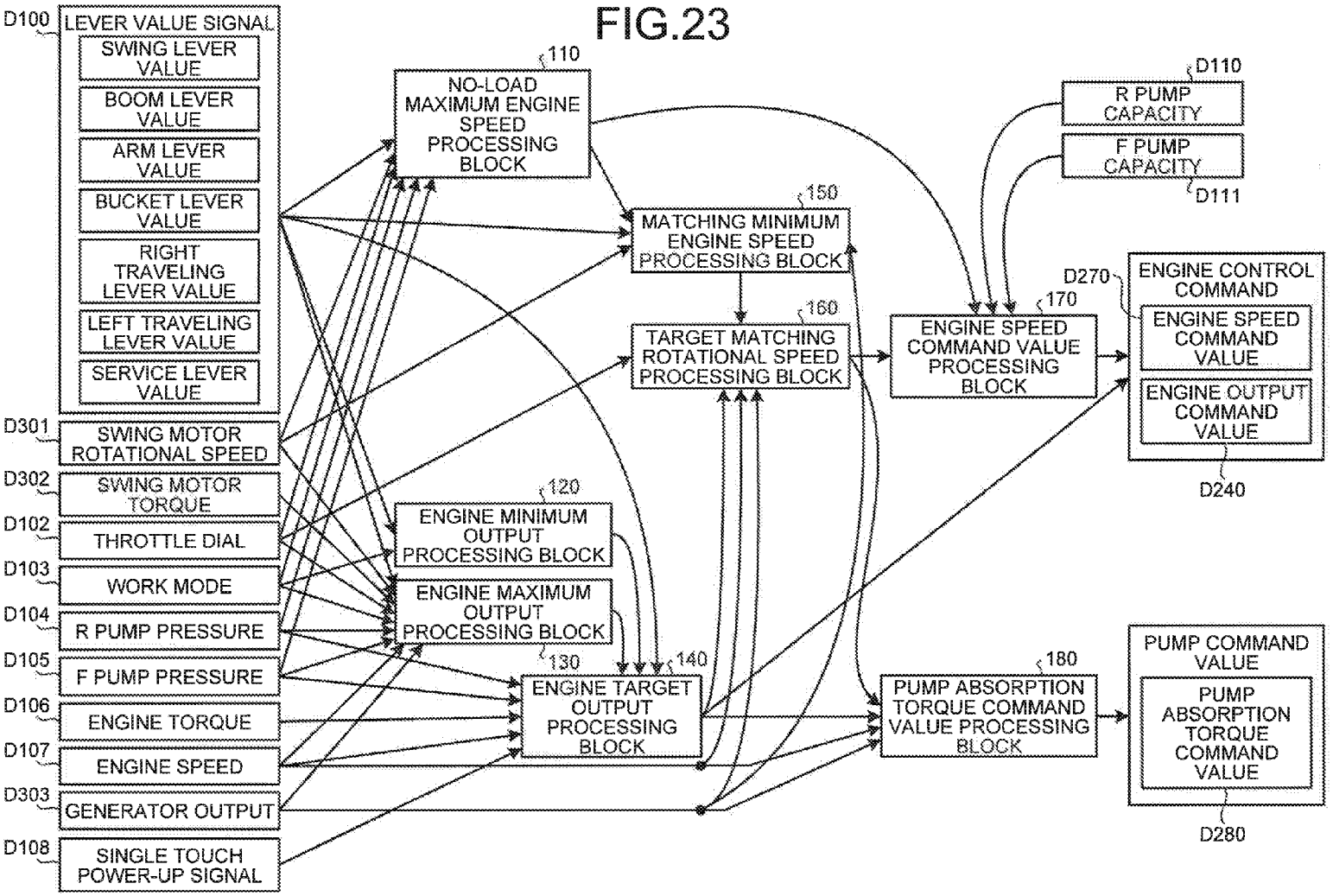
FIG. 23 is a figure illustrating an overall control flow of an engine controller, a pump controller, or a hybrid controller of the second embodiment of the present invention.
Figure 24:
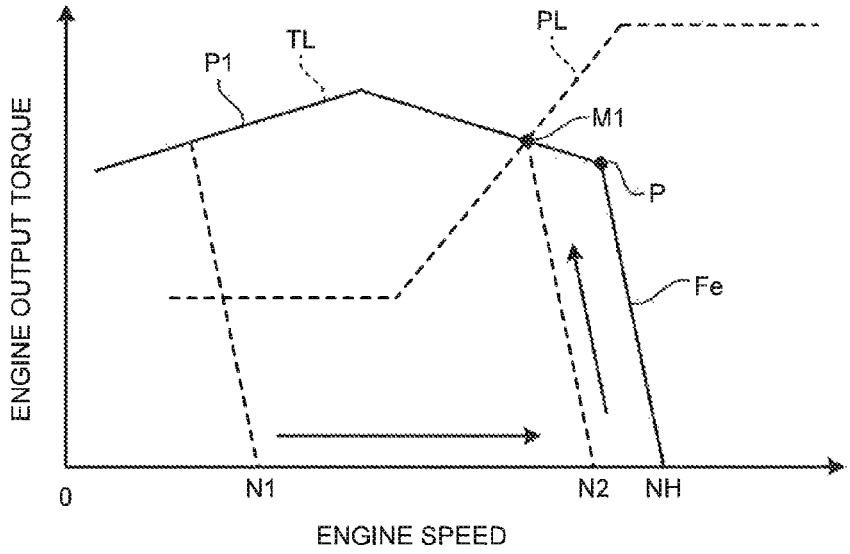
FIG. 24 is a torque line chart explaining a conventional engine control.

The engine control of the second embodiment is almost the same as the first embodiment. The control portion different from the first embodiment will be described below. FIG. 23 illustrates an overall control flow of the engine control of the hybrid excavator 1. The portion different from the overall control flow illustrated in FIG. 6 is that the input parameters are, instead of the swing-rotation speed D101 of the swing hydraulic motor 31, a swing motor rotational speed D301 of the swing motor 24 and swing motor torque D302, and generator output D303 is further added as an input parameter. The swing motor rotational speed D301 of the swing motor 24 is input to the no-load maximum engine speed processing block 110 and the engine maximum output processing block 130, and further to the matching minimum engine speed processing block 150. The swing motor torque D302 is input to the engine maximum output processing block 130. Further, the generator output D303 is input to the engine maximum output processing block 130, the matching minimum engine speed processing block 150, the target matching engine speed processing block 160, and the pump absorption torque command value processing block 180.

Similar to the first embodiment, the engine control processing such as setting the engine target output can also be carried out by the second embodiment.

REFERENCE SIGNS LIST

1 EXCAVATOR, HYBRID EXCAVATOR
2 VEHICLE MAIN BODY
3 WORK APPARATUS
4 BOTTOM TRAVELING BODY
5 UPPER SWING BODY
11 BOOM
12 ARM
13 BUCKET
14 BOOM CYLINDER
15 ARM CYLINDER
16 BUCKET CYLINDER
17 ENGINE
18 HYDRAULIC PUMP
18*a* SWASH PLATE ANGLE SENSOR
19 GENERATOR
20 CONTROL VALVE
20*a* PUMP PRESSURE DETECTING UNIT
21 TRAVELING MOTOR
22 CAPACITOR
23 INVERTER
23*a* HYBRID CONTROLLER
24 SWING MOTOR
25 ROTATION SENSOR
26R, 26L MANIPULATING LEVER
27 LEVER MANIPULATION AMOUNT DETECTING UNIT
28 FUEL ADJUSTMENT DIAL
29 MODE SWITCHING UNIT
29*a* SINGLE TOUCH POWER-UO BUTTON
30 ENGINE CONTROLLER
31 SWING HYDRAULIC MOTOR
32 COMMON RAIL CONTROL UNIT
33 PUMP CONTROLLER
140 ENGINE TARGET OUTPUT PROCESSING BLOCK
242 ENGINE ACTUAL OUTPUT PROCESSING BLOCK
246 INTEGRATING UNIT
301 ENGINE OUTPUT DECREASE ALLOWING INFORMATION GENERATING BLOCK
302 ENGINE ACTUAL OUTPUT LATCHING FUNCTION BLOCK
303 ENGINE TARGET OUTPUT PROCESSING UNIT
304 HYSTERESIS PROCESSING UNIT
305 LEVER MANIPULATION AMOUNT TOTAL SUM DECREASE FLAG PROCESSING UNIT
Pth HIGH PRESSURE THRESHOLD

The invention claimed is:

1. An engine control apparatus of a work machine including an engine, a work apparatus driven by at least engine power and a manipulating lever which operates at least an operation of the work apparatus, the apparatus comprising:

an engine output decrease allowing information generating unit configured to generate an engine output decrease allowing information which allows decrease in an engine output during a period in which a lever manipulation amount total sum of the manipulating lever is decreasing the lever manipulation amount total sum being at least based on the operation of the work apparatus;

an engine actual output processing unit configured to process an engine actual output based on engine torque and an engine speed;

a latching function unit configured to keep and output a maximum value of the engine actual output while the engine output decrease allowing information is not generated, and output a present value of the engine actual output while the engine output decrease allowing information is generated;

an engine target output processing unit configured to process and output an engine target output based on an engine output which is output by the latching function unit; and an engine controller configured to control the engine speed under limitation of the engine target output, wherein the engine output decrease allowing information generating unit includes a hysteresis processing unit configured to carry out hysteresis processing in which the lever manipulation amount total sum is determined to have decreased so that the engine output decrease allowing information generating unit starts generating the engine output decrease allowing information when an amount of change in a decreasing-direction of the lever manipulation amount total sum is not smaller than a predetermined amount, and the lever manipulation amount total sum is determined to have increased so that the engine output decrease allowing information generating unit stops generating the engine output decrease allowing information when an amount of change in an increasing-direction of the lever manipulation amount total sum is not smaller than, a predetermined amount, wherein the engine output decrease allowing information generating unit is configured not to generate the engine output decrease allowing information when a pump pressure exceeds a predetermined high pressure threshold.

2. The engine control apparatus of a work machine according to claim 1, further comprising a single touch power-up button configured to output a single touch power-up signal which gives a command to temporarily increase the engine output, wherein the engine output decrease allowing information generating unit is configured not to generate the engine output decrease allowing information during a period when the single touch power-up button signal is input.

3. The engine control apparatus of a work machine according to claim 1, wherein the engine target output processing unit is configured not to carry out processing in a direction in which an engine target output increases when the engine output decrease allowing information is generated.

4. The engine control apparatus of a work machine according to claim 1, wherein the work machine includes an electric swing mechanism.

5. An engine control method for a work machine including an engine, a work apparatus driven by at least engine power, and a manipulating lever which operates at least an operation of the work apparatus, the method comprising:

an engine output decrease allowing information generating step in which an engine output decrease allowing information which allows decrease in an engine output during a period when a lever manipulation amount total sum of a manipulating lever is decreasing is generated, the lever manipulation amount total sum being at least based on the operation of the work apparatus;

an engine actual output processing step in which an engine actual output is processed based on engine torque and an engine speed;

a latching function step in which a maximum value of the engine actual output is kept and output while the engine output decrease allowing information is not generated, and a present value of the engine actual output is output while the engine output decrease allowing information is generated;

an engine target output processing step in which an engine target output is processed and output based on an engine output which is output by the latching function step; and an engine control step in which the engine speed is controlled under limitation of the engine target output, wherein the engine output decrease allowing information generating unit includes a hysteresis processing unit configured to carry out hysteresis processing in which the lever manipulation amount total sum is determined to have decreased so that the engine output decrease allowing information generating step starts generating the engine output decrease allowing information when an amount of change in a decreasing-direction of the lever manipulation amount sum is not smaller than predetermined amount, and the lever manipulation amount total sum is determined to have increased so that the engine output decrease allowing information generating step stops generating the engine output decrease allowing information when an amount of change in an increasing-direction of the lever manipulation amount total sum is not smaller than a predetermined amount, wherein the engine output decrease allowing information generating unit is configured not to generate the engine output decrease allowing information when a pump pressure exceeds a predetermined high pressure threshold.

6. The engine control method for a work machine according to claim 5, wherein the work machine includes an electric swing mechanism.

7. An engine control apparatus of a work machine including an engine, a work apparatus driven by at least engine power and a manipulating lever which operates at least an operation of the work apparatus, the apparatus comprising:

an engine output decrease allowing information generating unit configured to generate an engine output decrease allowing information which allows decrease in an engine output during a period in which a lever manipulation amount total sum of the manipulating lever is decreasing;

an engine actual output processing unit configured to process an engine actual output based on engine torque and an engine speed;

a latching function unit configured to keep and output a maximum value of the engine actual output while the engine output decrease allowing information is not generated, and output a present value of the engine actual output while the engine output decrease allowing information is generated;

an engine target output processing unit configured to process and output an engine target output based on an engine output which is output by the latching function unit; and an engine controller configured to control the engine speed under limitation of the engine target output, wherein the engine output decrease allowing information generating unit includes a processing unit configured not to generate the engine output decrease allowing information when a pump pressure exceeds a predetermined high pressure threshold, and configured to generate the engine output decrease allowing information based on the lever manipulation amount total sum of the manipulating lever during the period in which the lever manipulation amount total sum of the manipulating lever is decreasing when the pump pressure does not exceed the predetermined high pressure threshold.

8. The engine control apparatus of a work machine according to claim 7, further comprising a single touch power-up button configured to output a single touch power-up signal which gives a command to temporarily increase the engine output, wherein the engine output decrease allowing information generating unit is configured not to generate the engine output decrease allowing information during a period when the single touch power-up button signal is input.

9. The engine control apparatus of a work machine according to claim 7, wherein the engine target output processing unit is configured not to carry out processing in a direction in which an engine target output increases when the engine output decrease allowing information is generated.

10. An engine control method for a work machine including an engine, a work apparatus driven by at least engine power, and a manipulating lever which operates at least an operation of the work apparatus, the method comprising:

an engine output decrease allowing information generating step in which an engine output decrease allowing information which allows decrease in an engine output during a period when a lever manipulation amount total sum of a manipulating lever is decreasing is generated;

an engine actual output processing step in which an engine actual output is processed based on engine torque and an engine speed;

a latching function step in which a maximum value of the engine actual output until present is kept and output during a period when the engine output decrease allowing information is not generated, and a present value of the engine actual output is output during a period when the engine output decrease allowing information is generated;

an engine target output processing step in which an engine target output is processed and output based on an engine output which is output by the latching function step; and an engine control step in which the engine speed is controlled under limitation of the engine target output, wherein the engine output decrease allowing information generating step includes a processing step of generating no engine output decrease allowing information when a pump pressure exceeds a predetermined high pressure threshold, and generating the engine output decrease allowing information based on the lever manipulation amount total sum of the manipulating lever during the period in which the lever manipulation amount total sum of the manipulating lever is decreasing when the pump pressure does not exceed the predetermined high pressure threshold.

* * * * *